US009320333B2

(12) United States Patent
Mizuno et al.

(10) Patent No.: US 9,320,333 B2
(45) Date of Patent: Apr. 26, 2016

(54) AUTOMATIC HEAD CARE DEVICE AND AUTOMATIC HEAD CARE METHOD

(71) Applicant: Panasonic Corporation, Osaka (JP)

(72) Inventors: Osamu Mizuno, Nara (JP); Soichiro Fujioka, Osaka (JP); Tohru Nakamura, Osaka (JP); Toshinori Hirose, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 155 days.

(21) Appl. No.: 14/346,256

(22) PCT Filed: Sep. 25, 2012

(86) PCT No.: PCT/JP2012/006099

§ 371 (c)(1),
(2) Date: Mar. 20, 2014

(87) PCT Pub. No.: WO2013/046645

PCT Pub. Date: Apr. 4, 2013

(65) Prior Publication Data

US 2015/0107016 A1 Apr. 23, 2015

(30) Foreign Application Priority Data

Sep. 30, 2011 (JP) ..... 2011-217158

(51) Int. Cl.
*A61H 7/00* (2006.01)
*A45D 19/14* (2006.01)
(Continued)

(52) U.S. Cl.
CPC ..... *A45D 19/14* (2013.01); *A45D 19/10* (2013.01); *A61H 7/004* (2013.01);
(Continued)

(58) Field of Classification Search
CPC ..... A45D 19/06; A45D 19/04; A45D 19/10; A45D 19/14; A61H 35/008; A61H 7/006
See application file for complete search history.

(56) References Cited

U.S. PATENT DOCUMENTS 3,603,320 A * 9/1971 Scipione ..... A61H 7/006 132/270
3,636,961 A * 1/1972 John ..... A45D 19/14 132/212

(Continued)

FOREIGN PATENT DOCUMENTS

CN 103068275 A 4/2013
JP 06-021636 U 3/1994

(Continued)

OTHER PUBLICATIONS

Translation of the International Preliminary Report on Patentability corresponding to PCT/JP2012/006099, dated Apr. 8, 2014.

(Continued)

*Primary Examiner* — Janie Loeppke
(74) *Attorney, Agent, or Firm* — Renner, Otto, Boisselle & Sklar, LLP

(57) ABSTRACT

Provided is an automatic head care device that can reliably care a person's rear head. The automatic head care device includes a rear-head care unit, the rear-head care unit including contact units, each unit having a rotation gear rotating a plurality of contacts around a central axis of the rotation gear, a third arm rotatably holding the contact units, a cylindrical rack held between the contact units to be movable in an axial direction of the cylindrical rack, the cylindrical rack moving in the axial direction to rotate the rotation gears in opposite directions, and a motor for oscillating the contacts of the contact units by moving the cylindrical rack.

10 Claims, 24 Drawing Sheets

(51) Int. Cl.
*A45D 19/10* (2006.01)
*A61H 15/00* (2006.01)
*A61H 35/00* (2006.01)

(52) U.S. Cl.
CPC ..... *A61H 15/0078* (2013.01); *A61H 35/008* (2013.01); *A61H 2201/0192* (2013.01); *A61H 2201/1215* (2013.01); *A61H 2201/1463* (2013.01); *A61H 2201/1607* (2013.01); *A61H 2201/1671* (2013.01); *A61H 2201/1676* (2013.01); *A61H 2201/1692* (2013.01); *A61H 2201/5007* (2013.01)

(56) References Cited

U.S. PATENT DOCUMENTS

| | | | | | |
|---|---|---|---|---|---|
| 4,078,557 | A * | 3/1978 | Spencer | A61H 7/006 | 132/212 |
| 5,081,986 | A * | 1/1992 | In | A61H 7/006 | 601/144 |
| 5,277,174 | A * | 1/1994 | Schmidhauser | A61H 7/006 | 601/70 |
| 6,024,100 | A * | 2/2000 | Fukuyama | A45D 19/16 | 132/200 |
| 2001/0001884 | A1 * | 5/2001 | Miyoshi | A45D 19/14 | 4/515 |
| 2002/0184703 | A1 * | 12/2002 | Minami | A45D 19/10 | 4/515 |
| 2004/0127822 | A1 * | 7/2004 | Eisenberg | A47C 1/06 | 601/49 |
| 2011/0239363 | A1 * | 10/2011 | Nagamatsu | A45D 19/16 | 4/519 |
| 2013/0145540 | A1 | 6/2013 | Mizuno et al. | | |

FOREIGN PATENT DOCUMENTS

| | | | |
|---|---|---|---|
| JP | 06-078821 | A | 3/1994 |
| JP | 07-236511 | A | 9/1995 |
| JP | 2003-245119 | A | 9/2003 |
| JP | 2010/178979 | A | 8/2010 |
| WO | WO 2010/090005 | A1 | 8/2010 |

OTHER PUBLICATIONS

International Search Report for corresponding International Application No. PCT/JP2012/006099 mailed Dec. 25, 2012.

Form PCT/ISA/237 for corresponding International Application No. PCT/JP2012/006099 dated Dec. 25, 2012.

Chinese Office Action and Search Report for corresponding Chinese Application No. 201280044648.8 mailed on Aug. 31, 2015 and English translation.

* cited by examiner

100

AUTOMATIC HEAD CARE DEVICE AND AUTOMATIC HEAD CARE METHOD

TECHNICAL FIELD

The present invention relates to an automatic head care device and an automatic head care method automatically caring a person's head in a medical field or beauty care industry.

BACKGROUND OF THE INVENTION

An example of person's head care is washing of a person's head including hair. In the industry of beauty care including hair styling and hair cutting, head washing is laborious and has been desired to be automated. Also in the medical field, head washing for inpatients is laborious and has been desired to be automated.

There has been known, for example, an automatic head washing device disclosed in Patent Document 1 that is washing a person's head automatically. The automatic hair washing device has a bowl accommodating a person's head, a mesh-like head support net supporting the head in the bowl from below, and a plurality of nozzles ejecting washing water toward the head from below. The automatic hair washing device ejects water from the nozzles, thereby washing hair of the person's head supported by the head support net. In the automatic hair washing device, ejecting pressure of each of the nozzles is controlled to be switched at predetermined time intervals. Patent Document 1 describes that such control causes persons whose hair is washed by the automatic hair washing device to feel as if they are massaged with human's hands.

Patent Document 1: WO 2010/090005

However, when the person's rear head is washed with the automatic hair washing device disclosed in Patent Document 1, unwashed spots in the person's rear head may be caused by the use of the mesh-like head support net, such that the person's rear head may not be sufficiently washed.

The present invention solves this problem, and its object is to provide an automatic head care device and an automatic head care method that can reliably care a person's rear head.

SUMMARY OF THE INVENTION

To attain the above-mentioned object, an automatic head care device according to the present invention includes a base having a head support supporting a person's head; and a rear-head care unit attached to the base, the rear-head care unit caring a person's rear head, and the rear-head care unit includes: first and second contact units, each unit having a rotation gear rotating a plurality of contacts provided at ends of the unit around a central axis of the rotation gear; a holding stage rotatably holding the respective first and second contact units; a cylindrical rack held between the first and second contact units to be movable in an axial direction of the cylindrical rack, the cylindrical rack moving in the axial direction to rotate the rotation gears of the first and second contact units in opposite directions; and an oscillating actuator oscillating the plurality of contacts of the first and second contact units by moving the cylindrical rack in the axial direction to rotate the rotation gears of the first and second contact units in opposite directions.

To attain the above-mentioned object, in an automatic head care method according to the present invention, the automatic head care device is used to care the person's head.

ADVANTAGE OF THE INVENTION

An automatic head care device or an automatic head care method according to the present invention can reliably care a person's rear head.

EMBODIMENTS OF THE INVENTION

Embodiments of the present invention will be described below with reference to the drawings. The same constituents are given the same reference symbols and description thereof may be omitted. To be easy to understand, the drawings schematically show each of the constituents.

According to the present invention, an automatic head washing device automatically washing a person's head will be described as an example of an automatic head care device automatically caring a person's head. The expression "caring a person's head" according to the present invention refers to at least one of washing of scalp of a person's head, washing hair of a person's head (hair washing), and massage of a person's head. In following description of the embodiments, a direction "left" or "right" refers to the direction when viewed from the person whose head is washed. Further, in the following description of the embodiments, a direction "front" or "rear" refers to the direction when viewed from the person whose head is washed. Furthermore, in the following description, the vertical direction is defined as a Z axis, and directions perpendicular to the Z axis are defined as an X axis and a Y axis.

First Embodiment

Figure 1:
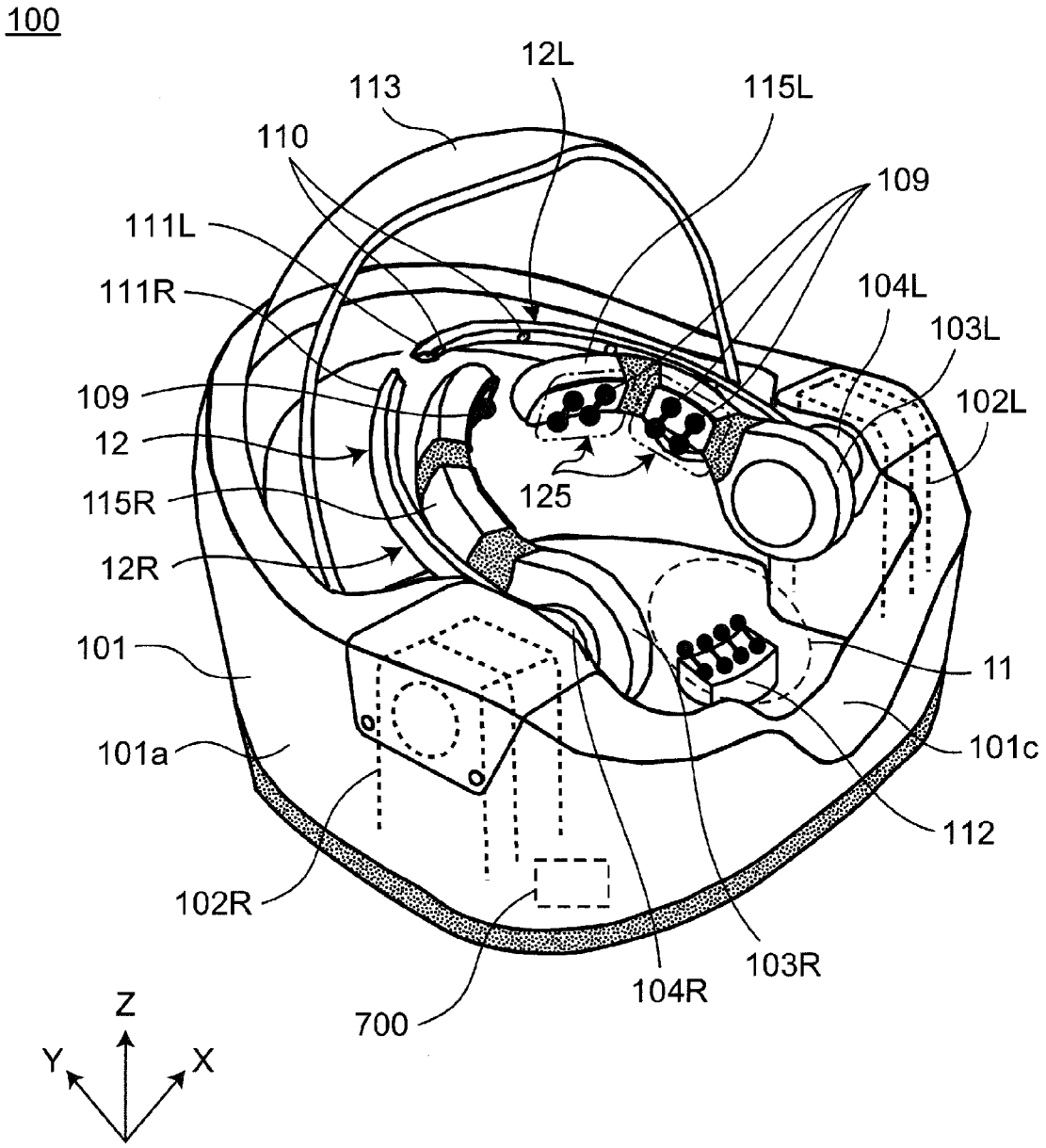
FIG. 1 is a view showing a schematic configuration of an automatic head washing device in accordance with a first embodiment of the present invention.
Figure 2:
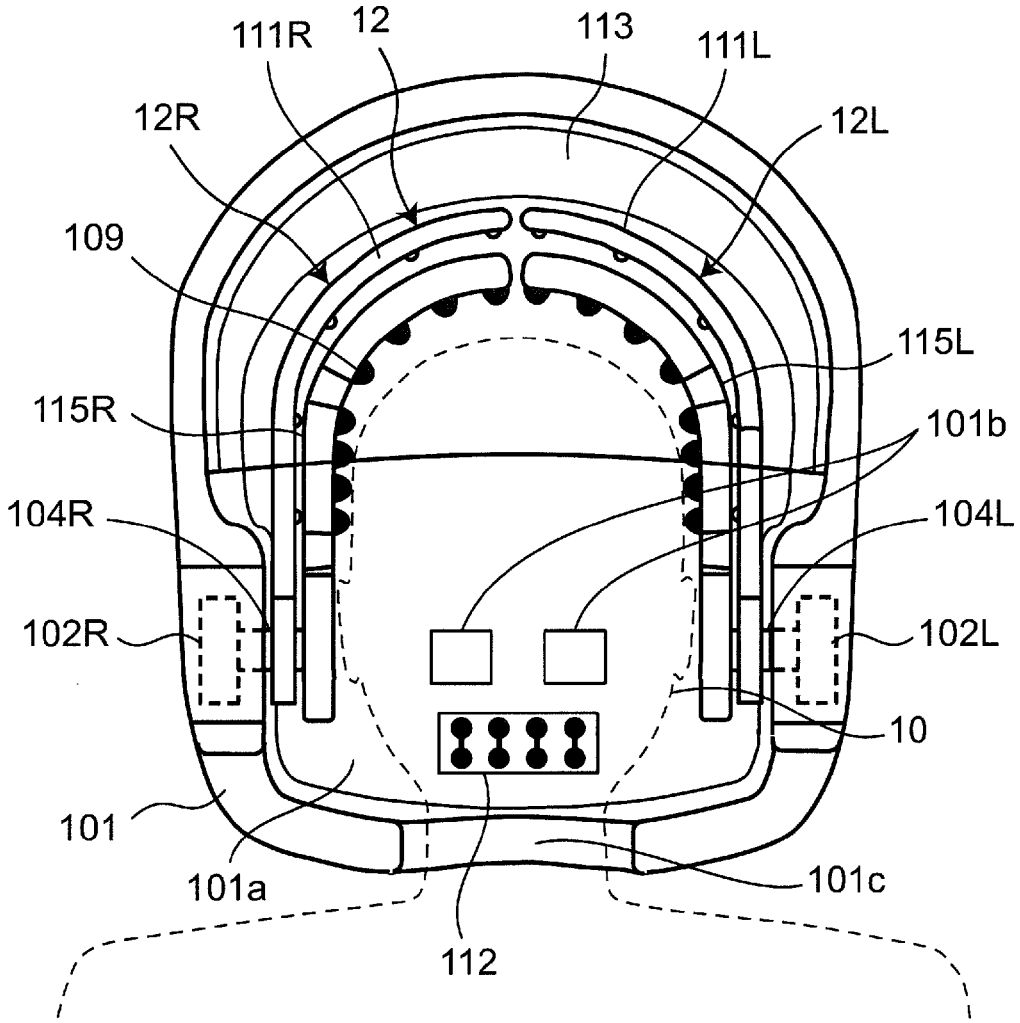
FIG. 2 is a plan view showing a schematic configuration of the automatic head washing device in accordance with the first embodiment.
Figure 3:
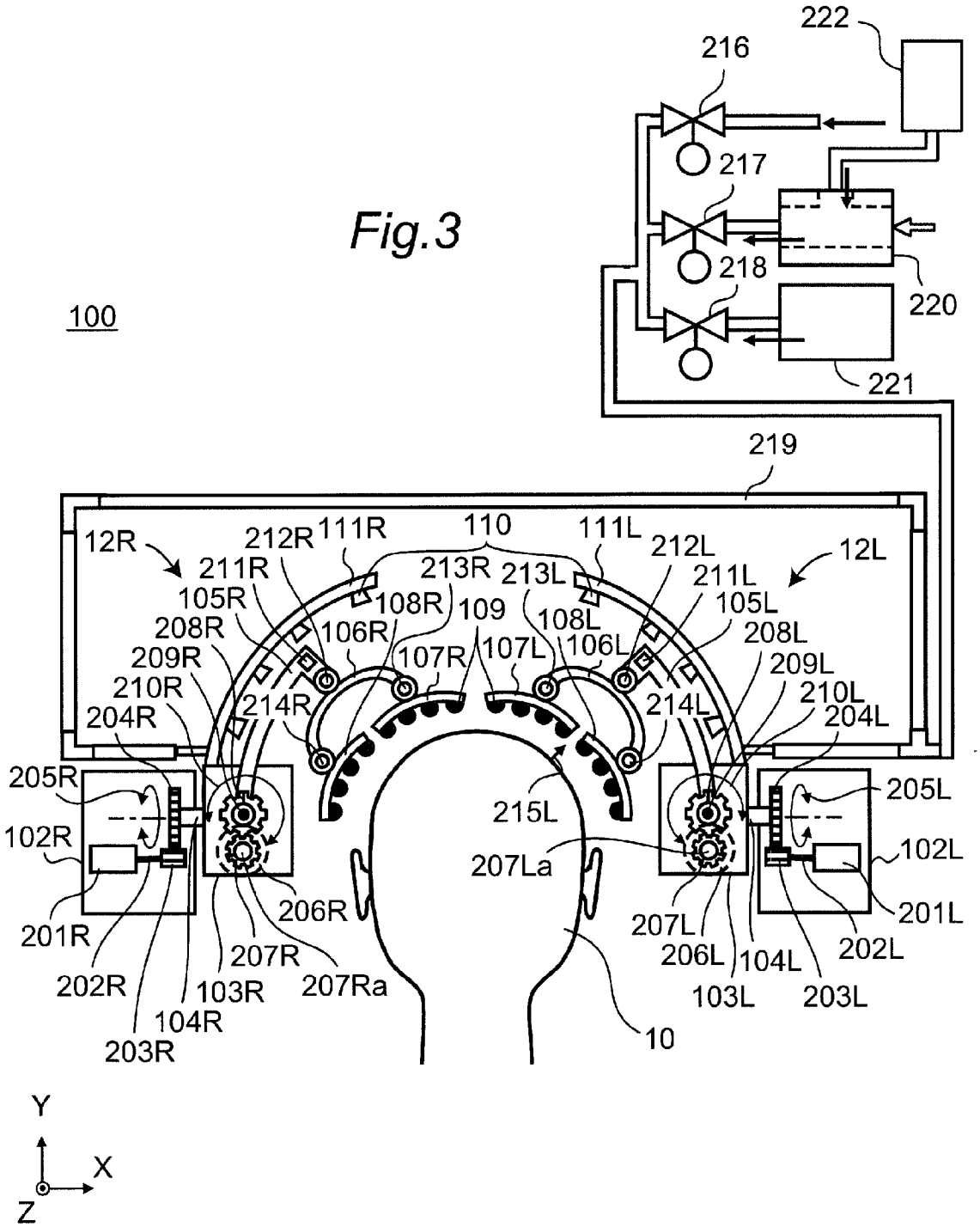
FIG. 3 is a view showing a configuration of a first main section of a drive mechanism of the automatic head washing device in accordance with the first embodiment.
Figure 4:
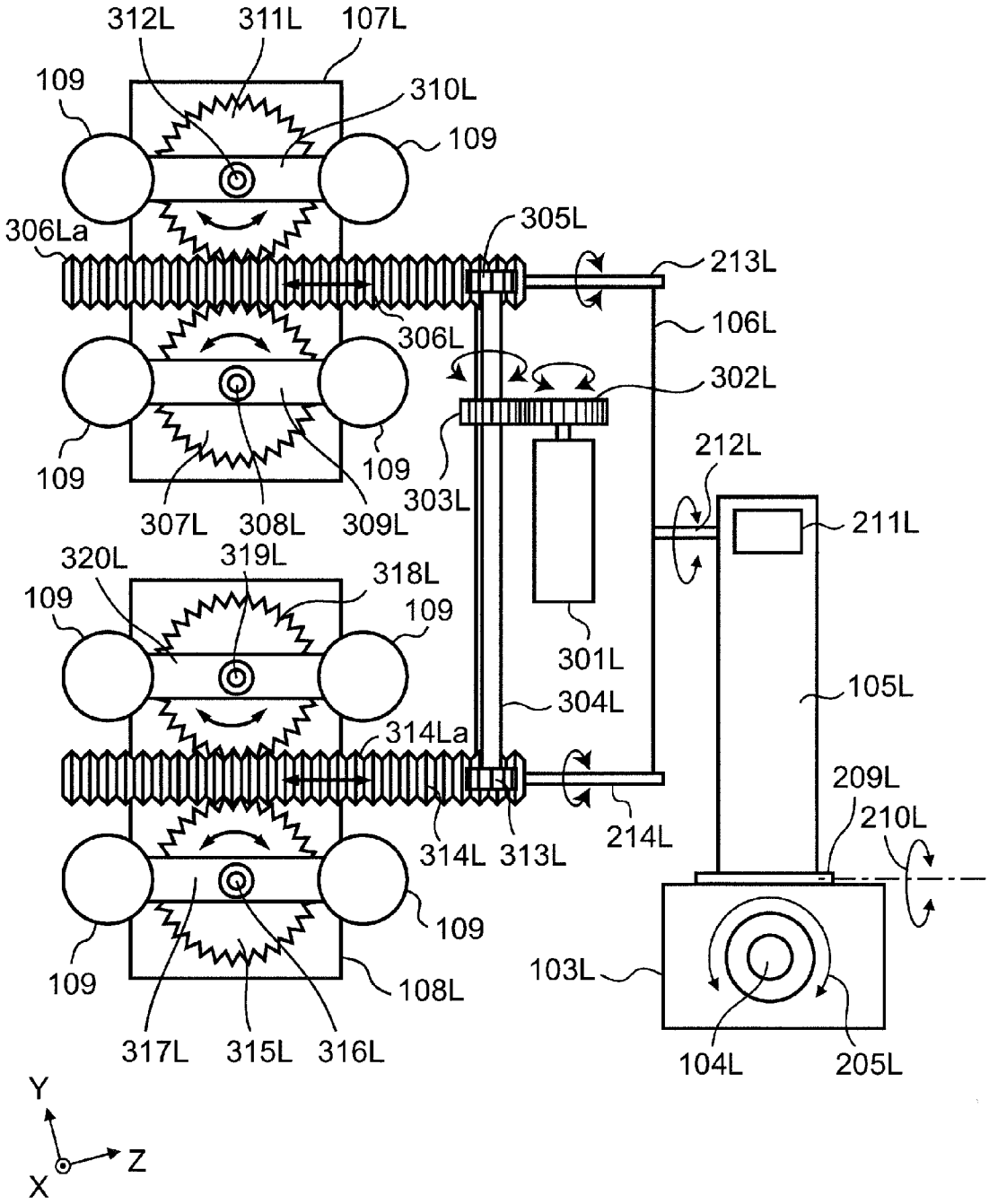
FIG. 4 is a view showing a configuration of a second main section of the drive mechanism of the automatic head washing device in accordance with the first embodiment.

FIG. 1 is a view showing a schematic configuration of an automatic head washing device in accordance with a first embodiment of the present invention. FIG. 2 is a plan view showing the schematic configuration of the automatic head washing device in accordance with the first embodiment. FIG. 3 is a view showing a configuration of a first main section of a drive mechanism of the automatic head washing device in accordance with the first embodiment. FIG. 4 is a view showing a configuration of a second main section of the drive mechanism of the automatic head washing device in accordance with the first embodiment.

As shown in FIG. 1, FIG. 2, and FIG. 3, the automatic head washing device 100 in accordance with the first embodiment has a bowl 101 configured to surround almost the rear half of a person's head 10, which serves as a base having a head support 11 supporting the person's (user's) head 10. Support columns 102L and 102R are mounted in a housing 101*a* constituting the bowl 101. The support columns 102L and 102R are disposed on the left side and the right side across the head support 11.

The bowl 101 of the automatic head washing device 100 encloses a pair of left and right washing units 12 washing the person's head 10 and a rear-head washing unit 112 washing the person's rear head. The washing units 12 and the rear-head washing unit 112 each are attached to the bowl 101.

First, the washing units 12 washing the person's head 10 will be described.

The washing units 12 is configured of the left washing unit 12L and the right washing unit 12R, which are disposed across the head support 11 in the bowl 101. A support shaft 104L of the left washing unit 12L is coupled to the support column 102L. The left washing unit 12L can rotate around the support shaft 104L. Similarly, a support shaft 104R of the right washing unit 12R is coupled to the support column 102R. The right washing unit 12R can rotate around the support shaft 104R.

As shown in FIG. 3, the left washing unit 12L has arms 105L, 106L, 107L, and 108L, and a pipe 111L. The arms 105L, 106L, 107L, and 108L, and the pipe 111L are disposed opposite to the head support 11. The arms 105L, 106L, 107L, and 108L each have a predetermined shape, that is, the arms are substantially arcuate, substantially linear, or the like. The pipe 111L has a predetermined shape, that is, the pipe is substantially arcuate or the like.

The pipe 111L of the left washing unit 12L has a plurality of nozzles 110 ejecting at least one of water, hot water, washing agent, and conditioner. The nozzles 110 are provided on a surface of the pipe 111L, which is opposed to the head support 11. The pipe 111L is attached to an arm base 103L fixed to the support shaft 104L, and can rotate around the support shaft 104L together with the arm base 103L.

The first arm 105L is attached to the arm base 103L, and can rotate around the support shaft 104L together with the arm base 103L.

The first arm 105L rotatably supports the second arm 106L. The second arm 106L rotatably supports the third arms 107L and 108L. A plurality of contacts 109 that make contact with the person's head 10 are attached to surfaces of the third arms 107L and 108L, the surfaces opposite to those supported by the support shaft 104L (surfaces opposed to the person's head 10 supported by the head support 11). The contacts 109 are made of a flexible rubber material. When the washing units 12 wash the person's head 10, the rear-head washing unit 112 functions as a support supporting the person's head 10. According to the present invention, when the rear-head washing unit 112 washes the person's rear head, the washing units 12 functions as a support supporting the person's head 10.

The first arm 105L, the second arm 106L, and the third arms 107L and 108L are stored in an arm housing 115L. The contacts 109 are disposed outside the arm housing 115L. The second arm 106L, and the third arms 107L and 108L may be supported by the first arm 105L and the second arm 106L, respectively, to be automatically aligned.

A motor 201L is disposed in the support column 102L. A rotation output of the motor 201L is transmitted to the support shaft 104L via a gear 203L attached to a motor rotation output shaft 202L and a gear 204L attached to the support shaft 104L. The arm base 103L attached to the support shaft 104L is configured to be driven by the rotation output transmitted from the motor 201L to be rotatable in the directions of an arrow 205L.

A motor 206L is disposed in the arm base 103L. A rotation output of the motor 206L is transmitted to the first arm 105L via a gear 207L attached to a motor rotation output shaft 207La and a gear 208L attached to an arm rotation shaft 209L of the first arm 105L. The first arm 105L is configured to be driven by the rotation output transmitted from the motor 206L to be rotatable around the arm rotation shaft 209L in the directions of an arrow 210L.

The first arm 105L includes a pressure sensor 211L detecting a force to press the person's head 10, and rotatably supports the second arm. 106L through a support shaft 212L. The second arm 106L rotatably supports the third arms 107L and 108L through support shafts 213L and 214L.

FIG. 4 is a view showing the third arms 107L and 108L when viewed from a skin surface of the head 10 in a normal direction 215L. To describe the drive transmitting system, FIG. 4 schematically shows arrangement of the arm base 103L, the first arm 105L, the second arm 106L, and so on.

As shown in FIG. 4, a motor 301L is disposed in the second arm 106L. A rotation output of the motor 301L is transmitted to a drive shaft 304L via a gear 302L attached to a motor rotation output shaft and a gear 303L attached to the drive shaft 304L. The drive shaft 304L is rotatably driven by the rotation output transmitted from the motor 301L.

A rotation output of a gear 305L attached to one end of the drive shaft 304L is transmitted to a gear 307L and a gear 311L, which are attached to the third arm 107L, via a cylindrical rack 306L. The cylindrical rack 306L is rotatably supported by the second arm 106L through the support shaft 213L, and is held to be movable parallel to the support shaft 213L. When the cylindrical rack 306L moves parallel to the support shaft 213L, that is, in the axial direction of the cylindrical rack 306L, the gear 307L rotates around a rotation shaft 308L. When the cylindrical rack 306L moves parallel to the support shaft 213L, that is, in the axial direction of the cylindrical rack 306L, the gear 311L rotates around a rotation shaft 312L.

The cylindrical rack 306L is substantially cylindrical as a whole, and includes an axisymmetric rack mechanism 306La on a side surface thereof. The cylindrical rack 306L is provided such that the rack mechanism 306La engages with the gear 305L attached to the drive shaft 304L, and with the gear 307L and the gear 311L.

A fourth arm 309L coupling the two contacts 109 disposed symmetrically about the rotation shaft 308L to each other is connected to the gear 307L. The two contacts 109 coupled to the fourth arm 309L rotate integrally with the gear 307L. Similarly, a fourth arm 310L coupling the two contacts 109 disposed symmetrically about the rotation shaft 312L to each other is connected to the gear 311L. The two contacts 109 coupled to the fourth arm 310L rotate integrally with the gear 311L. The central axes of the gear 307L and the gear 311L are located at the substantially same level in the axial direction of the cylindrical rack 306L.

A rotation output of a gear 313L attached to the other end of the drive shaft 304L is transmitted to a gear 315L and a gear 318L, which are attached to the third arm 108L, via a cylindrical rack 314L. The cylindrical rack 314L is supported by the second arm 106L through the support shaft 214L, and is held to be movable parallel to the support shaft 214L. When the cylindrical rack 314L moves parallel to the support shaft 214L, that is, in the axial direction of the cylindrical rack 314L, the gear 315L rotates around a rotation shaft 316L. When the cylindrical rack 314L moves parallel to the support shaft 214L, that is, in the axial direction of the cylindrical rack 314L, the gear 318L rotates around a rotation shaft 319L.

The cylindrical rack 314L is substantially cylindrical as a whole, and includes an axisymmetric rack mechanism 314La on a side surface thereof. The cylindrical rack 314L is provided such that the rack mechanism 314La engages with the gear 313L attached to the drive shaft 304L, and with the gear 315L and the gear 318L.

A fourth arm 317L coupling the two contacts 109 disposed symmetrically about the rotation shaft 316L to each other is connected to the gear 315L. The two contacts 109 coupled to the fourth arm 317L rotate integrally with the gear 315L. Similarly, a fourth arm 320L coupling the two contacts 109 disposed symmetrically about the rotation shaft 319 to each other is connected to the gear 318L. The two contacts 109 coupled to the fourth arm 320L rotate integrally with the gear 318L. The central axes of the gear 315L and the gear 318L are located at the substantially same level in the axial direction of the cylindrical rack 314L. The central axes of the cylindrical rack 306L and the cylindrical rack 314L are parallel to each other. The central axes of the gears 307L, 311L, 315L, and 318L are located at the substantially same level in the axial direction of the cylindrical racks 306L and 314L.

Figure 5A:
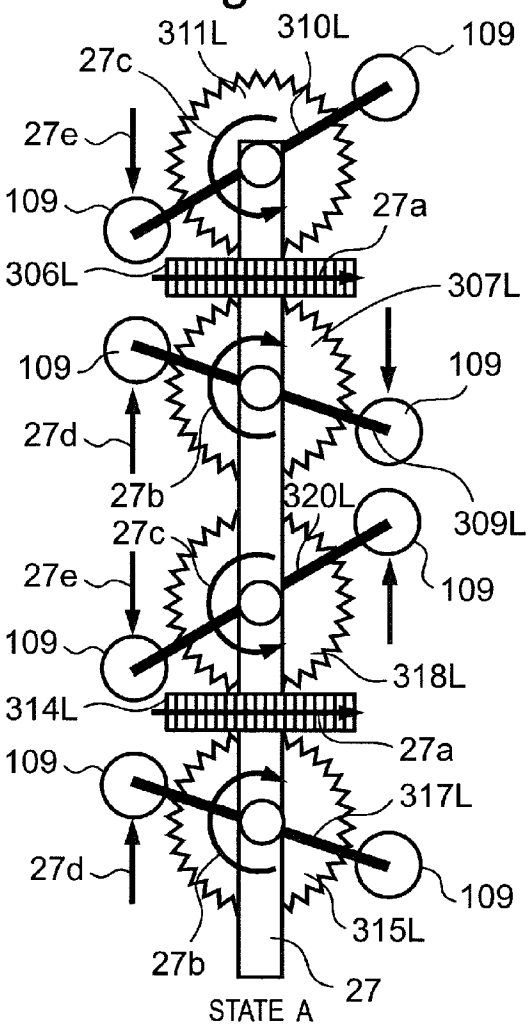
FIG. 5A is a view showing an operation of a third main section of the drive mechanism of the automatic head washing device in accordance with the first embodiment.
Figure 5B:
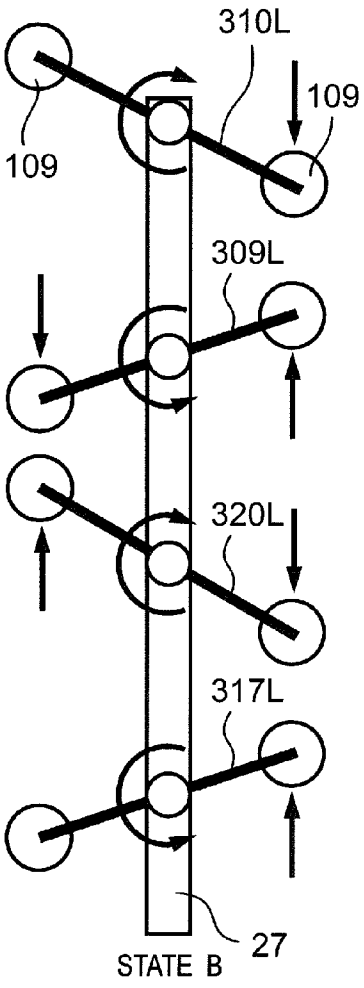
FIG. 5B is a view showing an operation of the third main section of the drive mechanism of the automatic head washing device in accordance with the first embodiment.

FIG. 5A and FIG. 5B are views showing the operation of a third main section of the drive mechanism of the automatic head washing device in accordance with the first embodiment. FIG. 5A and FIG. 5B show cylindrical racks 306L and 314L supported by the second arm 106L, the gears 307L, 311L, 315L, and 318L attached to the third arms 107L and 108L, the fourth arms 309L, 310L, 317L, and 320L, and the contacts 109. Schematically, the second arm 106L and the third arms 107L and 108L are integrally expressed as a bar 27.

As shown in FIG. 5A, in the left washing unit 12L, when the cylindrical rack 306L moves in the direction of an arrow 27*a*, the gears 307L and 311L adjacent to both respective sides of the cylindrical rack 306L rotate in opposite directions, i.e., in directions of arrows 27*b* and 27*c*, respectively. With this connection, the contacts 109 attached to the gear 307L via the fourth arm 309L and the contacts 109 attached to the gear 311L via the fourth arm 310L move in opposite directions, i.e., in directions of arrows 27*d* and 27*e*, respectively.

When the cylindrical rack 306L moves in the direction of the arrow 27*a*, the cylindrical rack 314L moves in the direction of the arrow 27*a*, and the gears 315L and 318L adjacent to both respective sides of the cylindrical rack 314L rotate in opposite directions, i.e., in directions of the arrows 27*b* and 27*c*, respectively. With this connection, the contacts 109 attached to the gear 315L via the fourth arm 317L and the contacts 109 attached to the gear 318L via the fourth arm 320L move in opposite directions, i.e., in directions of arrows 27*d* and 27*e*, respectively.

When the cylindrical racks 306L and 314L move in the direction of the arrow 27*a*, the adjacent gears 307L and 318L attached to the adjacent third arms 107L and 108L, respectively, rotate in opposite directions. The contacts 109 attached to the gear 307L via the fourth arm 309L and the contacts 109 attached to the gear 318L via the fourth arm 320L move in opposite directions, i.e., in directions of the arrows 27*d* and 27*e*, respectively. As described above, when the cylindrical racks 306L and 314L move in the direction of the arrow 27*a*, the two contacts 109 adjacent to each other in the direction orthogonal to the axial direction of the cylindrical racks 306L and 314L move to be closer to or away from each other in the directions of the arrows 27*d* and 27*e*.

After contact of the contacts 109 with scalp of the person's head 10, when the cylindrical racks 306L and 314L are moved in the direction of the arrow 27*a*, scalp areas in contact with the two contacts 109 can be closer to (or away from) each other. Thereby, scalp of the person's head 10 is contracted (or expanded). As a result, scalp of the person's head 10 is kneaded and massaged.

With the contacts 109 being in contact with hair of the person's head 10, when the cylindrical racks 306L and 314L are moved in the direction of the arrow 27*a*, hair between the contacts 109 can be caught (or pulled). Thus, bundles constituting hair of the person's head 10 can be displaced in various directions, and washed by rubbing.

On the contrary, as shown in FIG. 5B, when the cylindrical racks 306L and 314L are moved in the direction opposite to the direction of the arrow 27*a*, the gears 307L, 311L, 315L, and 318L and the contacts 109 each are moved in the direction opposite to the operating direction shown in FIG. 5A. In the left washing unit 12L, the cylindrical racks 306L and 314L are reciprocated in the direction of the arrow 27*a* and in the opposite direction, thereby alternatively repeating a state A in FIG. 5A and a state B in FIG. 5B. Such alternative repetition of the states can cause the contacts 109 oscillate and perform the rubbing operation to wash and massage the head.

The right washing unit 12R has the same configuration as that of the left washing unit 12L except that they are symmetric. The right washing unit 12R includes arms 105R, 106R, 107R, and 108R, and a pipe 111R. The arms 105R, 106R, 107R, and 108R, and the pipe 111R each are disposed opposite to the head support 11. The arms 105R, 106R, 107R, and 108R each have a predetermined shape, that is, the arms are substantially arcuate, substantially linear, or the like. The pipe 111R has a predetermined shape, that is, the pipe is substantially arcuate or the like. The pipe 111R has the same configuration as that of the pipe 111L, and is attached to an arm base 103R fixed to the support shaft 104R. The pipe 111R can rotate around the support shaft 104R together with the arm base 103R.

The arms 105R, 106R, 107R, and 108R are attached to the arm base 103R fixed to the support shaft 104R. The first arm 105R is attached to the arm base 103R, and can rotate around the support shaft 104R together with the arm base 103R.

The first arm 105R rotatably supports the second arm 106R. The second arm 106R rotatably supports the third arms 107R and 108R. The plurality of contacts 109 that make contact with the person's head 10 are attached to the third arms 107R and 108R. The first arm 105R, the second arm 106R, and the third arms 107R and 108R are stored in an arm housing 115R. The contacts 109 are disposed outside the arm housing 115R.

As shown in FIG. 3, a motor 201R is disposed in the support column 102R. A rotation output of the motor 201R is transmitted to the support shaft 104R via a gear 203R attached to a motor rotation output shaft 202R and a gear 204R attached to the support shaft 104R. The arm base 103R attached to the support shaft 104R is driven by the rotation output transmitted from the motor 201R to be rotatable in the directions of an arrow 205R.

A motor 206R is disposed in the arm base 103R. A rotation output of the motor 206R is transmitted to the first arm 105R via a gear 207R attached to a motor rotation output shaft 207Ra and a gear 208R attached to an arm rotation shaft 209R of the first arm 105R. The first arm 105R can be driven by the rotation output transmitted from the motor 206R to be rotatable around the arm rotation shaft 209R in the directions of an arrow 210R.

The first arm 105R is provided with a pressure sensor 211R detecting a force to press the person's head 10, and rotatably supports the second arm 106R through a support shaft 212R. The second arm 106R rotatably supports the third arms 107R and 108R through support shafts 213R and 214R.

The third arms 107R and 108R each have gears engaged with a cylindrical rack having an axisymmetric rack mechanism on the side surface, the cylindrical rack substantially cylindrical as a whole. A fourth arm coupling the two contacts 109 to each other is connected to each of the gears. The two contacts 109 are rotated by the motor in the second arm 106R integrally with the gear. The cylindrical racks of the right washing unit 12R are rotatably supported by the second arm 106R through the support shafts 213R and 214R, and are held to be movable parallel to the support shafts 213R and 214R.

A specific example of a second main section of the drive mechanism of the automatic head washing device 100 in accordance with the first embodiment will be described.

Figure 6:
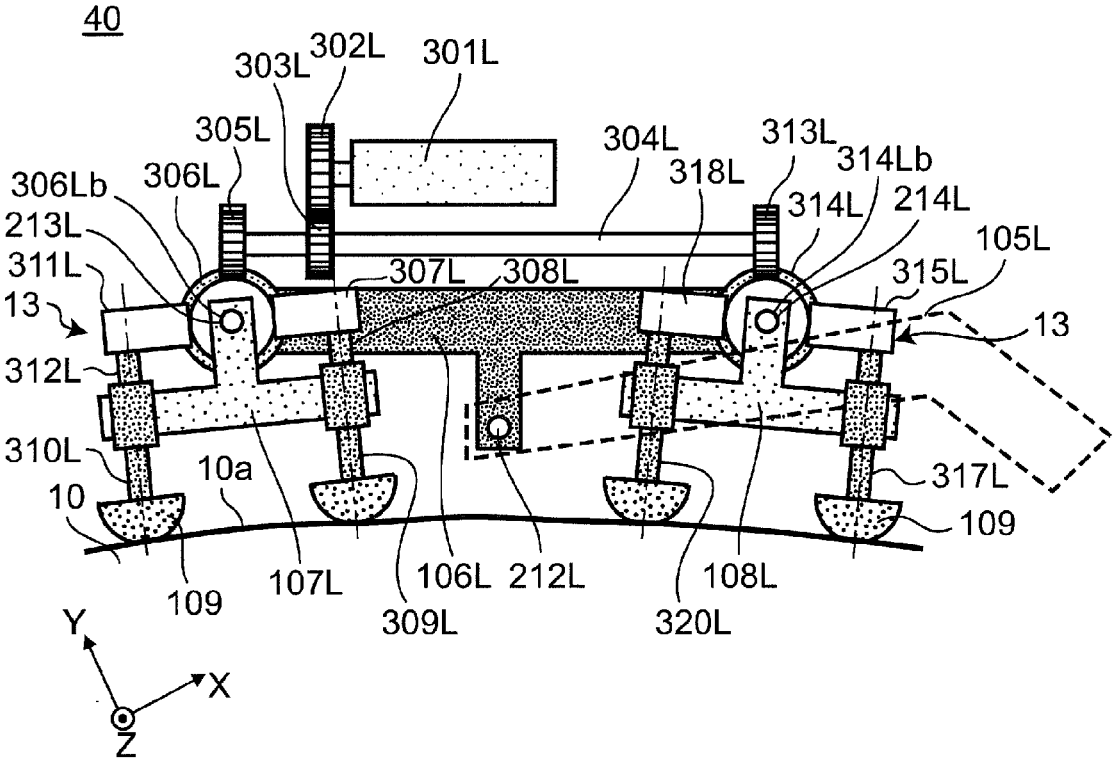
FIG. 6 is a side view showing a specific example of the second main section of the drive mechanism of the automatic head washing device in accordance with the first embodiment.
Figure 7:
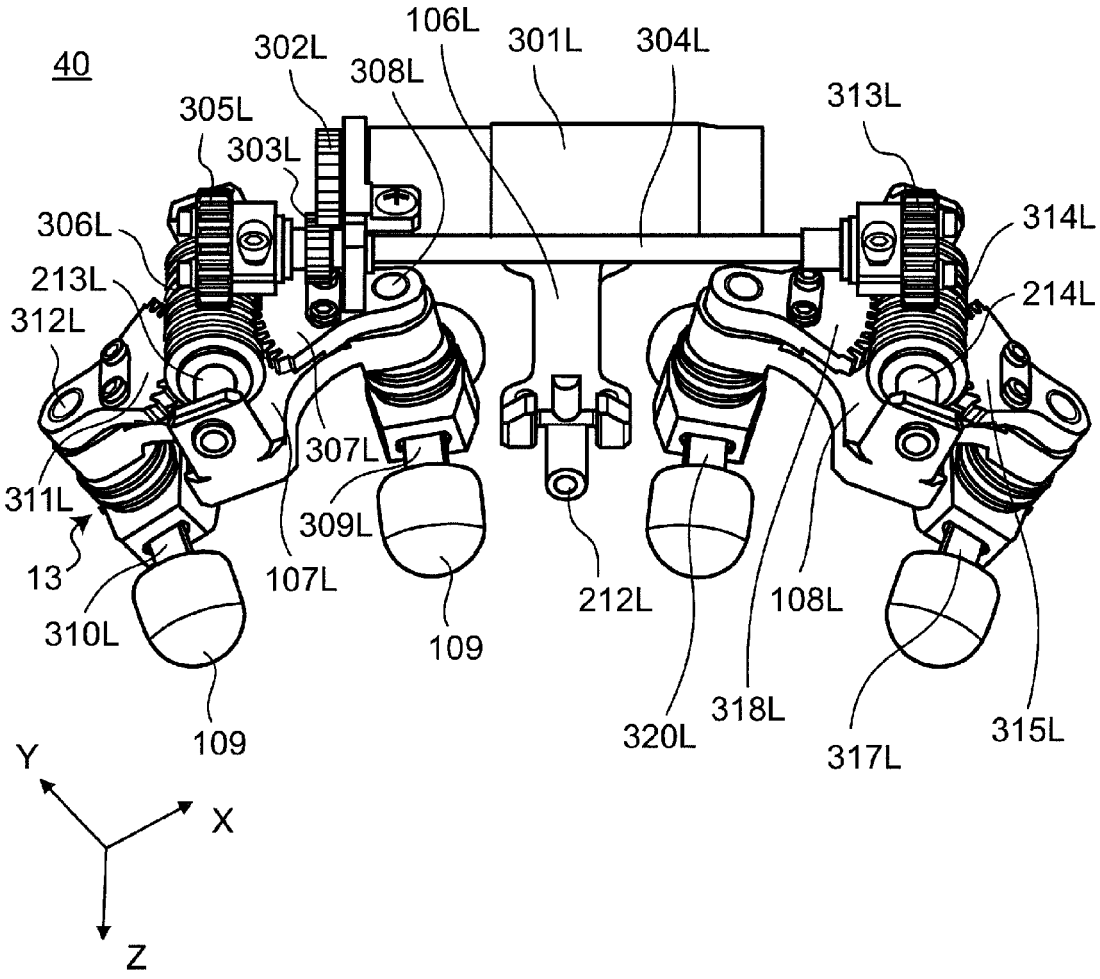
FIG. 7 is a perspective view showing a specific example of the second main section of the drive mechanism of the automatic head washing device in accordance with the first embodiment.

FIG. 6 is a side view showing the specific example of the second main section of the drive mechanism of the automatic head washing device in accordance with the first embodiment. FIG. 7 is a perspective view showing the specific example of the second main section of the drive mechanism of the automatic head washing device in accordance with the first embodiment. FIG. 6 and FIG. 7 show a specific example of a head care unit 40 configured of the second arm 106L and the third arms 107L and 108L. FIG. 6 and FIG. 7 show substantially linear second arm 106L, and third arms 107L and 108L, and fan-like gears 307L, 311L, 315L, and 318L attached to the third arms 107L and 108L.

As shown in FIG. 6 and FIG. 7, the unit configured of the second arm 106L, the third arms 107L and 108L, and the fourth arms 309L, 310L, 317L, and 320L forms the head care unit 40 in the automatic head washing device 100. The head care unit 40 includes the drive shaft 304L transmitting the output from the motor 301L disposed in the second arm 106L, the cylindrical racks 306L and 314L engaged with the gears 305L and 313L disposed on both ends of the drive shaft 304L, respectively, and the third arms 107L and 108L rotatably held by the support shafts 213L and 214L corresponding to central axes 306Lb and 314Lb of the cylindrical racks 306L and 314L, respectively.

In the head care unit 40, the rotation output of the motor 301L is transmitted to the gears 307L, 311L, 315L, and 318L attached to the third arms 107L and 108L via the gears 305L and 313L disposed at the both ends of the drive shaft 304L and the cylindrical racks 306L and 314L. The gears 307L, 311L, 315L, and 318L are rotated by the rotation output transmitted from the motor 301L, thereby rotating the two contacts 109 attached to each of the gears 307L, 311L, 315L, and 318L.

The two cylindrical racks 306L and 314L are rotatably supported by the second arm 106L through the support shafts 213L and 214L, respectively. The gear 307L engaged with the cylindrical rack 306L is connected to the rotation shaft 308L rotatably held by the third arm 107L. The rotation shaft 308L is connected to the fourth arm 309L coupling the two contacts 109 to each other. With this configuration, the gear 307L and the contacts 109 can integrally rotate around the rotation shaft 308L. The rotation shaft 308L is configured so as to maintain engagement between the cylindrical rack 306L and the gear 307L, for example, by flanges in top and bottom portions across the third arm 107L.

The gears 311L, 315L, and 318L have the same configuration as that of the gear 307L. The gears 311L, 315L, and 318L can rotate around the rotation shafts 312L, 316L, and 319L, respectively, integrally with the contacts 109. The gear 307L, the rotation shaft 308L, the fourth arm 309L, and the contacts 109, which are attached to the third arm 107L, constitute a contact unit 13 that makes contact with the person's head 10. The contact unit 13 includes the gear 307L having its central axis rotating the two contacts 109 disposed at front ends of the fourth arm 309L.

Figure 8:
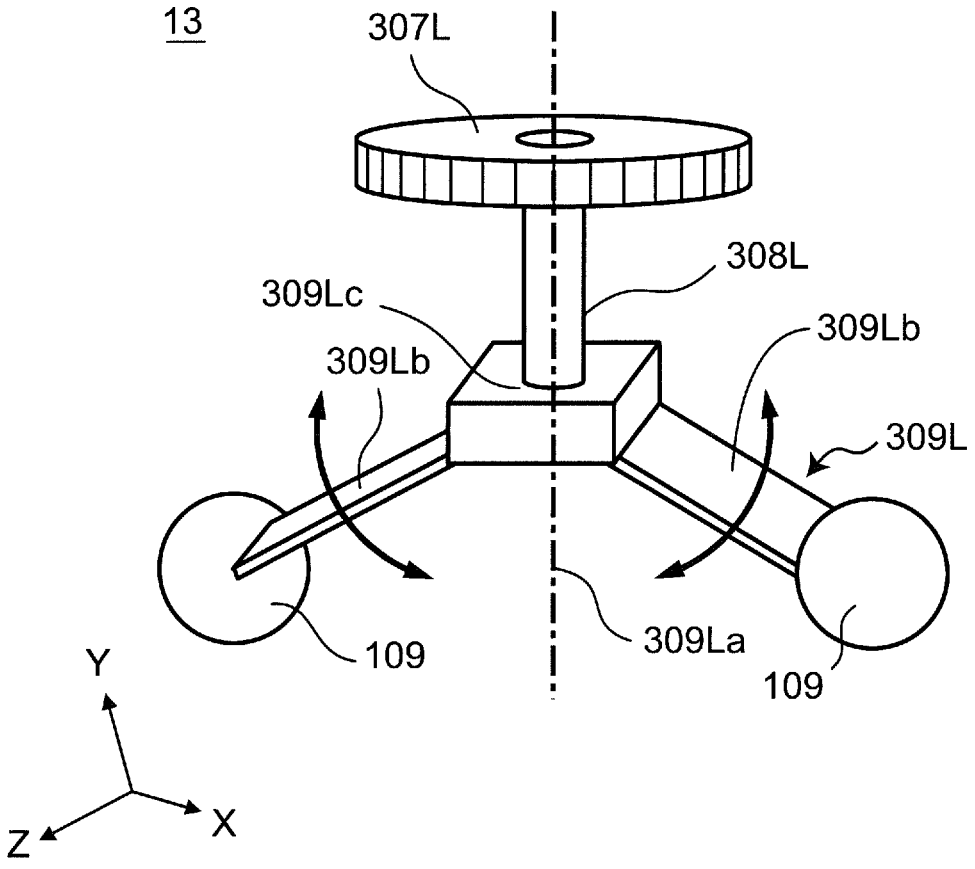
FIG. 8 is a perspective view showing a schematic configuration of a contact unit in the automatic head washing device in accordance with the first embodiment.

FIG. 8 is a perspective view showing a schematic configuration of the contact unit of the automatic head washing device in accordance with the first embodiment. In FIG. 8, the gear 307L attached to the third arm 107L is circular. As shown in FIG. 8, in the contact unit 13, the two contacts 109 that make contact with the person's head 10 are disposed at the front ends of the substantially V-like fourth arm 309L, and are symmetric about the central axis of the gear 307L. As shown in FIG. 8, in the contact unit 13, a rotation shaft 308L to which the gear 307L is connected, and an axis of symmetry 309La of the fourth arm 309L are arranged to be coincide with the central axis of the gear 307L.

The fourth arm 309L has a pair of branches 309Lb and a connection 309Lc. The connection 309Lc is connected to the rotation shaft 308L. The contact 109 is disposed at the front end of each branch 309Lb, and the branches 309Lb are symmetric about the axis of symmetry 309La. The connection 309Lc couples the two branches 309Lb to each other at the top of the two branches 309Lb disposed in a V-like manner.

In the contact unit 13, the fourth arm 309L includes an elastic body in at least a portion of an area ranging from the top of V-shaped branches 309Lb to the contacts 109. In the fourth arm 309L of the contact unit 13 in FIG. 8, the branches 309Lb are plate springs as an example of the elastic body.

In the contact unit 13, when the pressing force of the contact unit 13 onto the person's head 10 increases in the state where the two contacts 109 are in contact with the person's head 10, the distance between the top of the V-shaped branches 309Lb of the contact unit 13 and the person's head 10 decreases, and the interval between the two contacts 109 increases. On the contrary, when the pressing force of the contact unit 13 onto the person's head 10 decreases in the state where the two contacts 109 are in contact with the person's head 10, the distance between the top of the V-shaped two branches 309Lb of the contact unit 13 and the person's head 10 increases, and the interval between the two contacts 109 decreases.

As described above, when the pressing force of the contact unit 13 onto the person's head 10 varies in the state where the two contacts 109 of the contact unit 13 are in contact with the person's head 10, the distance between the top of the V-shaped two branches 309Lb and the person's head 10 varies, and the interval between the two contacts 109 also varies. That is, by changing the pressing force of the contact unit 13 onto the person's head 10, the interval between the two contacts 109 of the contact unit 13 can be adjusted, enabling efficient and reliable washing according to the shape of the person's head 10.

When the contact unit 13 moves along the person's head 10, the contacts 109 of the contact unit 13 moves smoothly and efficiently according to the surface profile of a scalp 10*a* of the person's head 10. The contacts 109 move along the scalp 10*a* to generate a shear stress onto the scalp 10*a*, and are pressed onto the scalp 10*a* to generate a normal stress onto the scalp 10*a*. In this manner, since the contact unit 13 can finely change the position of the contacts 109 during washing according to the shape of the person's head 10, the automatic head washing device 100 can wash the person's head 10 uniformly and efficiently.

In the contact unit 13, while the contacts 109 are pressed onto the person's head 10, the axis of symmetry 309La of the fourth arm 309L, to which the contacts 109 are attached, is directed to the center of the person's head 10. That is, the contacts 109 are oriented in the substantially same direction as a normal perpendicular to a tangent of the person's head 10.

In this manner, the contacts 109 are pressed toward the center of the person's head 10 due to an elastic force of the branches 309Lb as the plate springs, and thus are accurately positioned according to the surface profile of the person's head 10. Thereby, the person's head 10 can be washed smoothly and efficiently.

The contact unit 13 includes an opening angle adjusting mechanism capable of changing the opening angle between the pair of V-shaped branches 309Lb. The opening angle between the pair of branches 309Lb in the contact unit 13 is flexibly maintained in a predetermined angle range by the opening angle adjusting mechanism. The opening angle adjusting mechanism preferably adjusts the opening angle between the pair of branches 309Lb to be in the range of 60 to 150 degrees.

In the head care unit 40 including the contact unit 13 thus configured, the contact unit 13 is rotatably held at the third arms 107L and 108L. In the head care unit 40, the third arms 107L and 108L are rotatably held at the second arm 106L by the support shafts 213L and 214L, respectively.

The second arm 106L is rotatably supported by the first arm 105L through the support shaft 212L. When the first arm 105L rotates toward the person's head 10, the second arm 106L moves toward the person's head 10, bringing the contacts 109 attached to the third arms 107L and 108L into contact with the person's head 10.

Figure 9A:
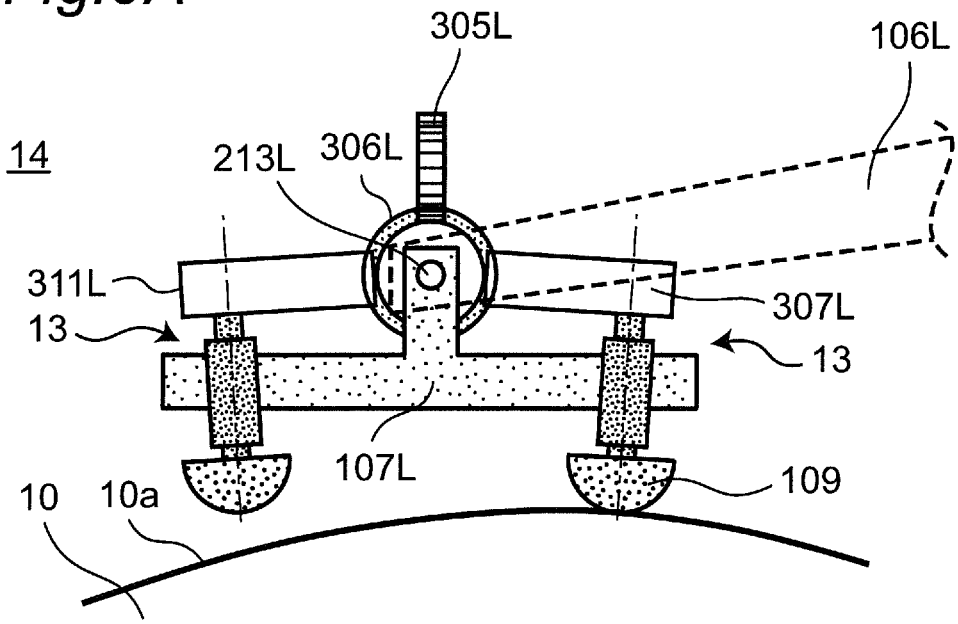
FIG. 9A is a view showing an operation of a fourth main section of the drive mechanism of the automatic head washing device in accordance with the first embodiment.
Figure 9B:
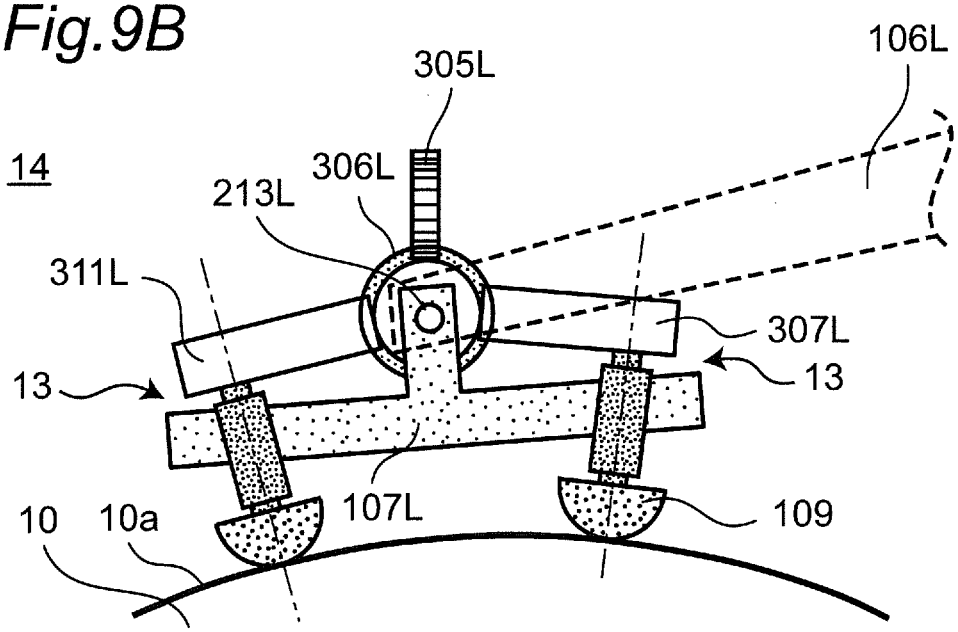
FIG. 9B is a view showing an operation of the fourth main section of the drive mechanism of the automatic head washing device in accordance with the first embodiment.

FIG. 9A and FIG. 9B are views showing the operation of a fourth main section of the drive mechanism of the automatic head washing device in accordance with the first embodiment. FIG. 9A and FIG. 9B show the state where the contacts 109 in the two contact units 13 are in contact with the scalp 10*a* of the person's head 10. As shown in FIG. 9A and FIG. 9B, one split unit 14 is configured of the two contact units 13, the third arm 107L to which the two contact units 13 are attached, and the cylindrical rack 306L supported by the third arm 107L as well as by the second arm 106L. FIG. 9A and FIG. 9B also show the gear 305L engaged with the cylindrical rack 306L.

As shown in FIG. 9A, when the second arm 106L moves toward the person's head 10, the third arm 107L moves toward the person's head 10, and one contact unit 13 attached to the third arm 107L is pressed onto the scalp 10*a* of the person's head 10. The second arm 106L moves toward the person's head 10 with the movement of the first arm 105L toward the person's head 10, and the movement of the first arm 105L is made by controlling driving of the motor 206L.

When one contact unit 13 attached to the third arm 107L is pressed onto the scalp 10*a* of the person's head 10, the two contacts 109 are moved to be away from each other in the direction orthogonal to the pressing direction. FIG. 9A and FIG. 9B show the state where the two contacts 109 overlap.

When the second arm 106L further moves toward the person's head 10 and the pressing force of the contact unit 13 onto the person's head 10 increases, one contact unit 13 makes contact with the person's head 10 and then, as shown in FIG. 9B, the third arm 107L is inclined and the other contact unit 13 attached to the third arm 107L is pressed onto the person's head 10. Engagement between the cylindrical rack 306L and the gears 307L and 311L is maintained even when the third arm 107L is inclined.

Referring to FIG. 3 again, in the automatic head washing device 100, the pressing force to press the contact unit 13 onto the person's head 10 is changed by controlling driving of the motor 206L. That is, the motor 206L functions as a pressing actuator capable of changing the pressing force. The operation of the motor 206L can be adjusted based on the pressing force on the person's head 10, which is detected by the pressure sensors 211L and 211R, and be controlled to apply a predetermined pressure to the person's head 10. In this manner, the plurality of contacts 109 can press each area of the person's head 10 with optimum contact pressure at optimum positions according to the shape of the head 10 to wash the person's head 10.

In the head care unit 40, the third arms 107L and 108L are rotatably supported by the second arm 106L through the support shafts 213L and 214L, respectively. The split unit 14 provided in the longitudinal direction of the left washing unit 12L is rotatably supported by the second arm 106L. As described above, the second arm 106L is supported by the first arm 105L through the support shaft 212L.

In the head care unit 40, when the second arm 106L moves toward the person's head 10, the third arm 107L moves toward the person's head 10, and one split unit 14 attached to the second arm 106L is pressed onto the scalp 10*a* of the person's head 10. When the second arm 106L further moves toward the person's head 10, the other split unit 14 attached to the second arm 106L is pressed onto the scalp 10*a* of the person's head 10, bringing the contacts 109 of the split unit 14 provided opposed to the person's head 10 into contact with the scalp 10*a* of the person's head 10.

As described above, the head care unit 40 includes the contact units 13 each having the plurality of contacts 109 at its front ends, the third arms 107L and 108L rotatably holding the contact units 13, the cylindrical racks 306L and 314L, and the motor 301L oscillating the plurality of contacts 109. The contact units 13 include the gears 307L, 311L, 315L, and 318L having their central axes rotating the plurality of contacts 109. The cylindrical racks 306L and 314L are held to be movable in the axial direction, and move in the axial direction to rotate the gears 307L, 311L, 315L, and 318L of the contact units 13. The motor 301L moves the cylindrical racks 306L and 314L in the axial directions of the cylindrical racks 306L and 314L, rotating the gears 307L, 311L, 315L, and 318L to oscillate the plurality of contacts 109. The third arms 107L and 108L are an example of a holding stage. The motor 301L is an example of an oscillating actuator. The gears 307L, 311L, 315L, and 318L are an example of a rotation gear.

The head care unit 40 includes a pressing mechanism moving the support shafts 213L and 214L to the person's head 10. The pressing mechanism moves the support shafts 213L and 214L to the person's head 10, and the motor 301L oscillates the plurality of contacts 109. As a result, the plurality of contacts 109 apply stresses to the person's head 10. The pressing mechanism is configured of the motor 206L, the gears 207L and 208L, the first arm 105L, and the second arm 106L.

With this configuration, even when the shape of the person's head 10 varies, scalp and hair of the person's head 10 can be washed efficiently and reliably according to the shape of the person's head 10. With this configuration, in addition to reliable washing, the amount of used water and shampoo can be reduced and moreover, the amount of dirt water can be reduced.

Although the above-mentioned head care unit 40 has the two third arms rotatably holding the contact units 13, the present invention is not limited to this, and three or more third arms may be provided. By providing the plurality of third arms in the head care unit 40, the person's head 10 can be efficiently washed in a wider range.

In the head care unit 40, since the contact units 13 disposed on both sides of the cylindrical racks 306L and 314L are horizontally disposed, the thickness of the head care unit 40 can be reduced. This can make the head care unit 40 compact.

As shown in FIG. 3, the automatic head washing device 100 has a water system valve 216, a washing agent system valve 217, and a conditioner system valve 218. Outlets of the water system valve 216, the washing agent system valve 217, and the conditioner system valve 218 are connected to one another in parallel, and are further connected to the pipes 111L and 111R through piping 219.

The water system valve 216 has an inlet connected to a water system supplying unit to receive water or hot water from the outside. The washing agent system valve 217 has an inlet connected to a mixing unit 220 to receive mousse-like washing agent formed by mixing washing agent from a washing agent supplying unit 222 supplying washing agent such as shampoo with compressed air in the mixing unit 220. The conditioner system valve 218 has an inlet connected to a conditioner supplying unit 221 to receive conditioner (for example, rinse) from the conditioner supplying unit 221.

In the automatic head washing device 100, the water system valve 216, the washing agent system valve 217, and the conditioner system valve 218 are appropriately controlled so that water, hot water, mousse-like washing agent, or conditioner can be ejected from the plurality of nozzles 110 provided on the pipes 111L and 111R.

The water supplying unit supplying water or hot water to the washing units 12L and 12R is configured of the water system supplying unit and the water system valve 216. The washing agent supplying unit supplying washing agent to the washing units 12L and 12R is configured of the washing agent supplying unit 222, the mixing unit 220, and the washing agent system valve 217. The conditioner supplying unit supplying conditioner to the washing units 12L and 12R is configured of the conditioner supplying unit 221 and the conditioner system valve 218.

In the automatic head washing device 100, two drain ports 101*b* are provided at the bottom of the housing 101*a* of the bowl 101. Water and the like used washing are discharged from the drain ports 101*b*. A drain pipe is connected to each of the drain ports 101*b*, and water or the like discharged from the drain ports 101*b* are treated outside.

The bowl 101 is provided with a notch 101*c* supporting a person's neck. The bowl 101 is also provided with the rear-head washing unit 112 supporting the rear part of the person's head 10. The rear-head washing unit 112 can be adjusted in position in the vertical direction, the forward and rearward direction, and the right and left direction, and for example, can be positioned based on the position of the person's head 10, which is detected by a position detector such as a camera detecting the position of the person's head 10.

The rear-head washing unit 112 is preferably adjusted in position such that the support shafts 104L and 104R of the washing units 12L and 12R are located near person's ears. By driving the washing units 12L and 12R based on the positions of portions near person's ears, stress on person's neck can be suppressed. As described above, the rear-head washing unit 112 can also act as a washing unit washing person's rear head.

The support columns 102L and 102R mounted in the bowl 101 can move in the axial directions of the support shafts 104L and 104R attached to the support columns 102L and 102R, respectively. Thus, the distance between the person's head 10 and the arm bases 103L and 103R can be adjusted according to the size of the person's head 10 supported by the rear-head washing unit 112.

To prevent water, shampoo, or the like from scattering to the outside during washing, the bowl 101 is detachably provided with an openable/closable hood 113. The hood 113 is preferably, made of a transparent material (for example, transparent resin) so as not to give oppressed feeling and anxiety during washing.

As shown in FIG. 1, it is desirable that the automatic head washing device 100 is detachably provided with a cover 125 covering the contacts 109 of the washing units 12L and 12R. The cover 125 may be formed to cover one contact 109 or a plurality of contacts 109.

By attaching the cover 125 to the contacts 109, water, shampoo, or dirt of head washing can be prevented from directly adhering to the contacts 109. In the case where stains and so on are adhered to the cover 125, the cover 125 can be replaced to keep the contact area with the person's head clean. By replacing the cover 125 each time the user changes, the person's head 10 can be washed in a clean state at all times.

When the automatic head washing device 100 washes the person's head 10, the person's head 10 may be provided with a water shield. In this case, the water shield blocks water and so on ejected from the nozzles 110, thereby preventing water and so on from putting on person's face.

The automatic head washing device 100 includes a control device 700 as an example of a control unit comprehensively controlling the operation of the entire automatic head washing device 100. The control device 700 can independently drive the left washing unit 12L and the right washing unit 12R. The control device 700 controls the motors 201L and 201R to independently drive the left washing unit 12L and the right washing unit 12R to be rotatable about the support shafts 104L and 104R, respectively. The control device 700 controls the motors 206L and 206R to independently drive the left washing unit 12L and the right washing unit 12R to be rotatable about the arm rotation shafts 209L and 209R, respectively. The control device 700 controls the motor 301L to rotate the contacts 109. The control device 700 controls opening/closing of the water system valve 216, the washing agent system valve 217, and the conditioner system valve 218.

Thus, in the automatic head washing device 100, the control device 700 can rotate the plurality of contacts 109 while pressing the plurality of contacts 109 onto the person's head 10 in the state where water, hot water, mousse-like washing agent, or conditioner is ejected from the nozzles 110. Moreover, the automatic head washing device 100 can wash the person's head 10 with various washing operations by rotating the left washing unit 12L and the right washing unit 12R about the support shafts 104L and 104R, respectively.

The automatic head washing device 100 in accordance with the first embodiment is an device automatically washing the person's head 10, and can be used as a device automatically massaging the person's head 10 with the contacts 109 in the state where water, shampoo, or the like is not ejected from the nozzles 110.

Next, the rear-head washing unit 112 washing the person's rear head will be described.

As described above, the rear-head washing unit 112 serves to wash the person's rear head and moreover, when the washing units 12 wash the person's head 10, functions as a support supporting the person's head 10.

Figure 10A:
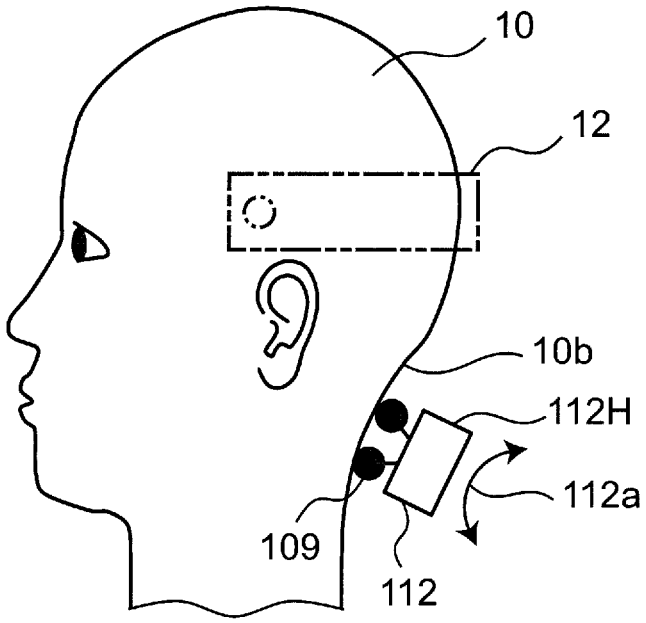
FIG. 10A is a view schematically showing a rear-head washing unit in the automatic head washing device in accordance with the first embodiment.
Figure 10B:
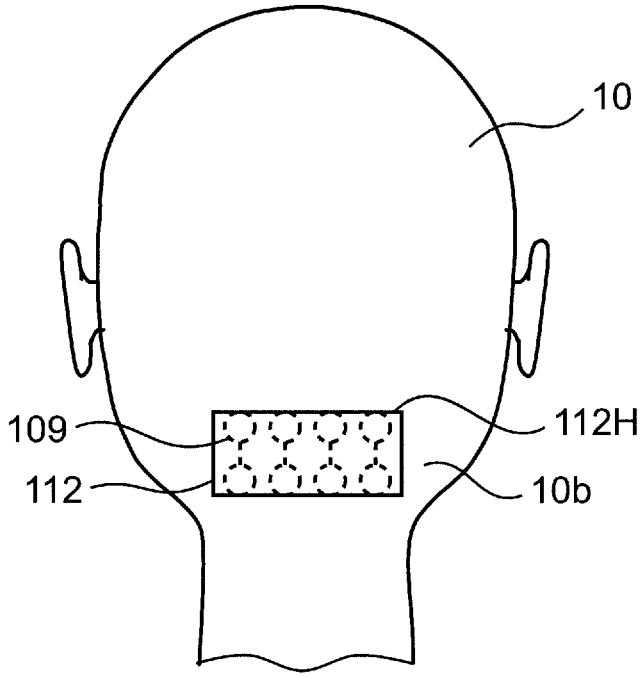
FIG. 10B is a view schematically showing the rear-head washing unit in the automatic head washing device in accordance with the first embodiment.

FIG. 10A and FIG. 10B schematically show the rear-head washing unit in the automatic head washing device in accordance with the first embodiment. FIG. 10A and FIG. 10B show arrangement of the rear-head washing unit with respect to a person's head supported by the head support. As shown in FIG. 10A and FIG. 10B, the rear-head washing unit 112 is located to be in contact with the rear head 10*b* at the center of the rear part of the person's head 10 supported by the head support 11.

FIG. 10A shows the washing units 12 with a chain double-dashed line. As shown in FIG. 10A, when the rear-head washing unit 112 washes the person's rear head 10*b*, the washing units 12 are controlled such that the left washing unit 12L and the right washing unit 12R rotate about the support shafts 104L and 104R, respectively, to wash the person's head 10 with the contacts 109 of the left washing unit 12L and the right washing unit 12R.

As described above, the rear-head washing unit 112 can be adjusted in position in the vertical direction, the forward and rearward direction, and the right and left direction. As shown in an arrow 112*a* in FIG. 10A, the rear-head washing unit 112 can be configured to rotate a housing 112H of the rear-head washing unit 112 around a support shaft. The rear-head washing unit 112 thus configured can move along the rear head 10*b* of the person's head 10.

Figure 11:
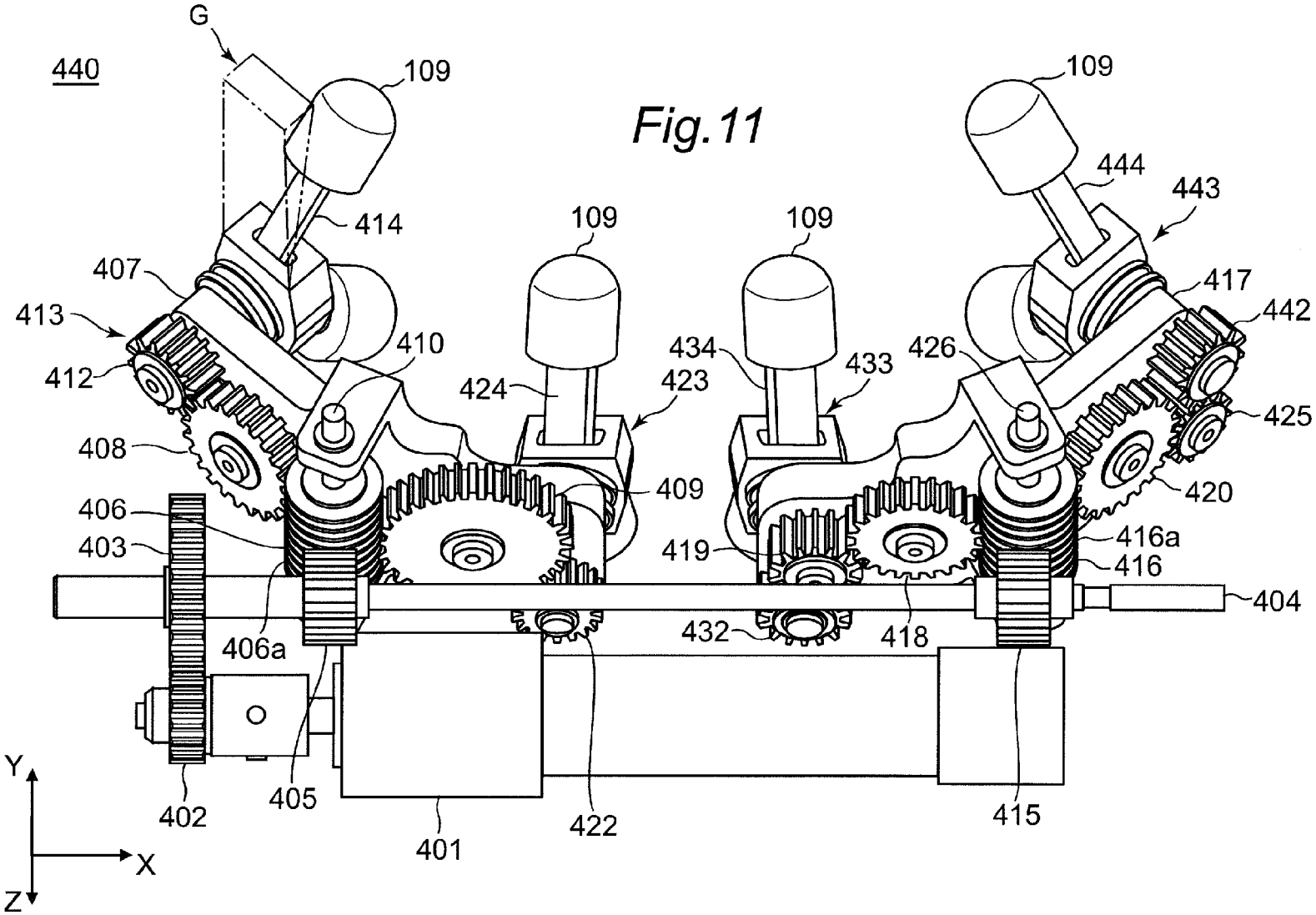
FIG. 11 is a perspective view showing a first main section of a drive mechanism of the rear-head washing unit in the automatic head washing device in accordance with the first embodiment.
Figure 12:
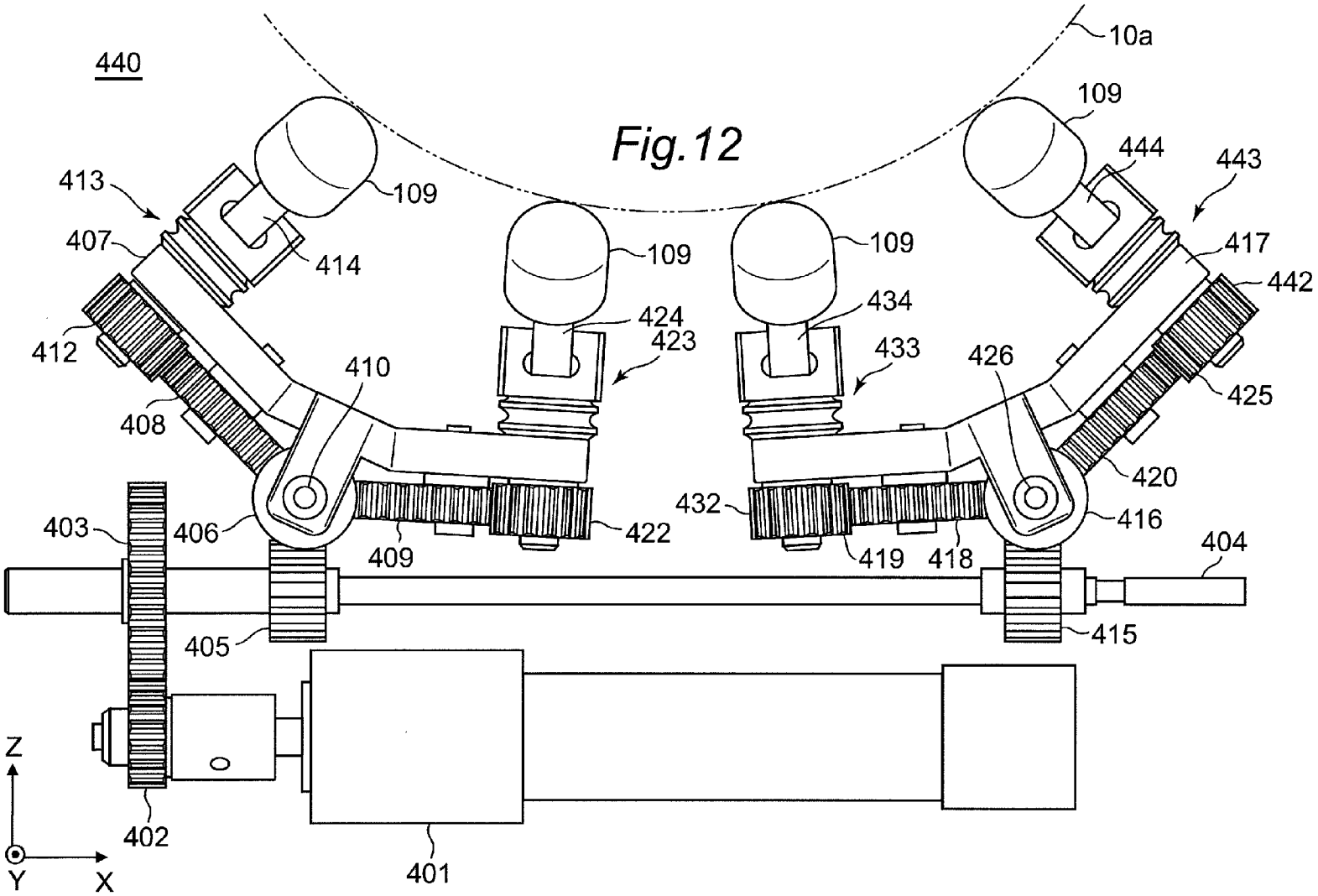
FIG. 12 is a side view showing the first main section of the drive mechanism of the rear-head washing unit in the automatic head washing device in accordance with the first embodiment.
Figure 13:
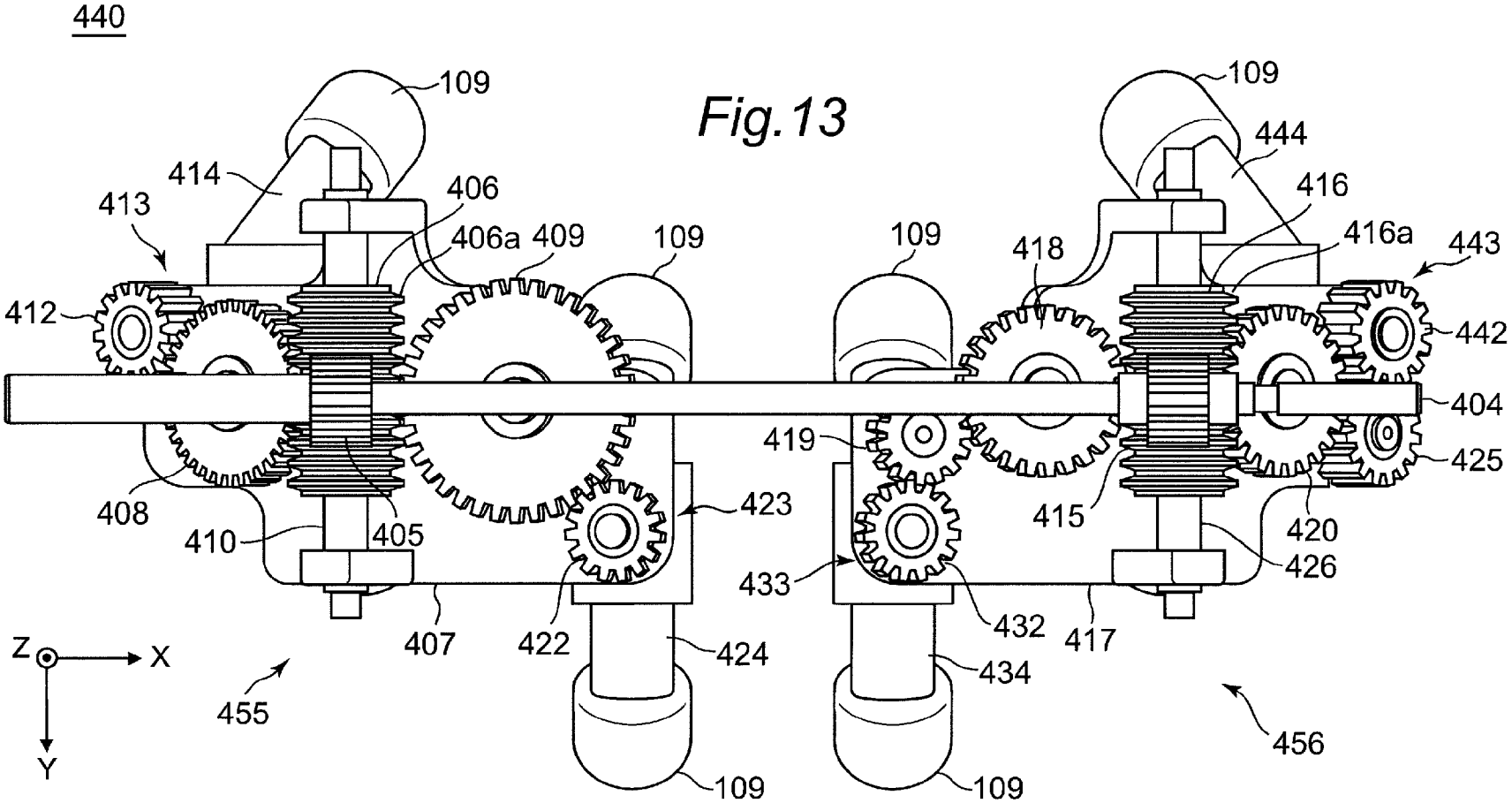
FIG. 13 is a bottom view showing the first main section of the drive mechanism of the rear-head washing unit in the automatic head washing device in accordance with the first embodiment.

FIG. 11 is a perspective view showing a first main section of a drive mechanism of the rear-head washing unit in the automatic head washing device in accordance with the first embodiment. FIG. 12 is side view showing the first main section of the drive mechanism of the rear-head washing unit in the automatic head washing device in accordance with the first embodiment. FIG. 13 is a bottom view showing the first main section of the drive mechanism of the rear-head washing unit in the automatic head washing device in accordance with the first embodiment. FIG. 11 to FIG. 13 show a rear-head care unit 440 without the housing 112H of the rear-head washing unit 112.

The rear-head washing unit 112 has the rear-head care unit 440 having the substantially same configuration as that of the head care unit 40. The rear-head care unit 440 performs at least one of washing of scalp of the person's rear head 10*b*, washing of hair of the person's rear head 10*b*, and massaging of the person's rear head 10*b* to care the person's rear head 10*b*. In the rear-head care unit 440, as described below, the central axes of the gears of the two contact units rotatably held by the third arm are offset from each other in the axial direction of the cylindrical rack. The same constituents of the rear-head care unit 440 as those of the head care unit 40 are expressed as the same terms. In the rear-head care unit 440, the housing 112H functions as the second arm.

As shown in FIG. 11 to FIG. 13, the rear-head care unit 440 has contact units 413, 423, 433, and 443. The units 413, 423, 433, and 443 include the plurality of contacts 109 that make contact with the person's rear head 10*b* at their front ends, and gears 412, 422, 432, and 442 having their central axes rotating the two contacts 109. The two contacts 109 are symmetric about the central axis. The contact units 413, 423, 433, and 443 have the same configuration as that of the contact unit 13 in FIG. 8 except for the gears.

The rear-head care unit 440 has a motor 401 disposed in the housing 112H. A rotation output of the motor 401 is transmitted to a drive shaft 404 via a gear 402 attached to a motor rotation output shaft and a gear 403 attached to the drive shaft 404. The drive shaft 404 can be rotated by the rotation output transmitted from the motor 401.

A rotation output of a gear 405 attached to one end of the drive shaft 404 is transmitted to gears 408 and 409 rotatably held by a third arm 407 via a cylindrical rack 406. Rotations of the gears 408 and 409 by the rotation output transmitted from the gear 405 are transmitted to the gears 412 and 422 of the contact units 413 and 423 rotatably held by the third arm 407, respectively.

The cylindrical rack 406 is rotatably held by a support shaft 410 rotatably supported by the housing 112H, and is held to be movable in the axial direction of the cylindrical rack 406, that is, parallel to the support shaft 410. When the cylindrical rack 406 moves in its axial direction, the gear 412 rotates around the central axis of the gear 412. When the cylindrical rack 406 moves in its axial direction, the gear 422 rotates around the central axis of the gear 422.

The cylindrical rack 406 is substantially cylindrical as a whole, and includes an axisymmetric rack mechanism 406*a* on a side surface thereof. The cylindrical rack 406 is provided such that the rack mechanism 406*a* engages with the gear 405 attached to the drive shaft 404, and with the gears 408 and 409 engaged with the gears 412 and 422 of the contact units 413 and 423, respectively.

A rotation output of a gear 415 attached to the other end of the drive shaft 404 is transmitted to gears 418 and 419 rotatably held by a third arm 417 via a cylindrical rack 416. Rotation of a gear 419 by the rotation output transmitted from the gear 415 is transmitted to the gear 432 of the contact unit 433 attached to the third arm 417. The rotation output of the gear 415 is transmitted to gears 420 and 425 rotatably held by the third arm 417 via the cylindrical rack 416. Rotation of the gear 425 is transmitted to the gear 442 of the contact unit 443 attached to the third arm 417.

The cylindrical rack 416 is rotatably held by a support shaft 426 rotatably supported by the housing 112H, and is held to be movable in the axial direction of the cylindrical rack 416, that is, parallel to the support shaft 426. The cylindrical rack 416 moves in its axial direction, thereby rotating the gear 432 around its central axis. The cylindrical rack 416 moves in its axial direction, thereby rotating the gear 442 around its central axis.

The cylindrical rack 416 is substantially cylindrical as a whole, and includes an axisymmetric rack mechanism 416*a* on a side surface thereof. The cylindrical rack 416 is provided such that the rack mechanism 416*a* engages with the gear 415 attached to the drive shaft 404, and with the gears 418 and 420, rotations of which are transmitted to the gears 432 and 442 of the contact units 433 and 443.

In the units 413, 423, 433, and 443, like in the contact unit 13, fourth arms 414, 424, 434, and 444 coupling two contacts 109 disposed symmetrically about the central axes of the gears 412, 422, 432, and 442 to each other are connected to the gears 412, 422, 432, and 442, respectively. The two contacts 109 rotate integrally with the respective gears 412, 422, 432, and 442.

In the rear-head care unit 440 of the rear-head washing unit 112, as shown in FIG. 13, the central axes of the gears 412 and 422 of the contact units 413 and 423 disposed across the cylindrical rack 406 are offset from each other in the axial direction of the cylindrical rack 406. The central axes of the gears 432 and 442 of the contact units 433 and 443 disposed across the cylindrical rack 416 are offset from each other in the axial direction of the cylindrical rack 416.

As shown in FIG. 12, the third arm 407 has linear portions that rotatably hold the two contact units 413 and 423, respectively, but is curved to conform to the person's rear head 10*b* as a whole. Similarly, the third arm 417 has linear portions that rotatably hold the two contact units 433 and 443, respectively, but is curved to conform to the person's rear head 10*b* as a whole.

For simplification, in FIG. 13, the motor 401, the gear 402 attached to the motor rotation output shaft of the motor 401, and the gear 403 attached to the drive shaft 404 are omitted. As shown in FIG. 13, the cylindrical racks 406 and 416 are disposed such that their central axes are parallel to each other.

The rear-head washing unit 112 includes split units 455 and 456. The split unit 455 is configured of the two contact units 413 and 423, the third arm 407, and the cylindrical rack 406. The split unit 456 is configured of the two contact units 433 and 443, the third arm 417, and the cylindrical rack 416. The split unit 455 includes the intermediate gears 408 and 409 in gaps among the cylindrical rack 406 and the gears 412 and 422 of the contact units 413, 423, and the split unit 456 includes the intermediate gears 418, 419, 420, and 425 in gaps among the cylindrical rack 416 and the gears 432 and 442 of the contact units 433 and 443.

Figure 14:
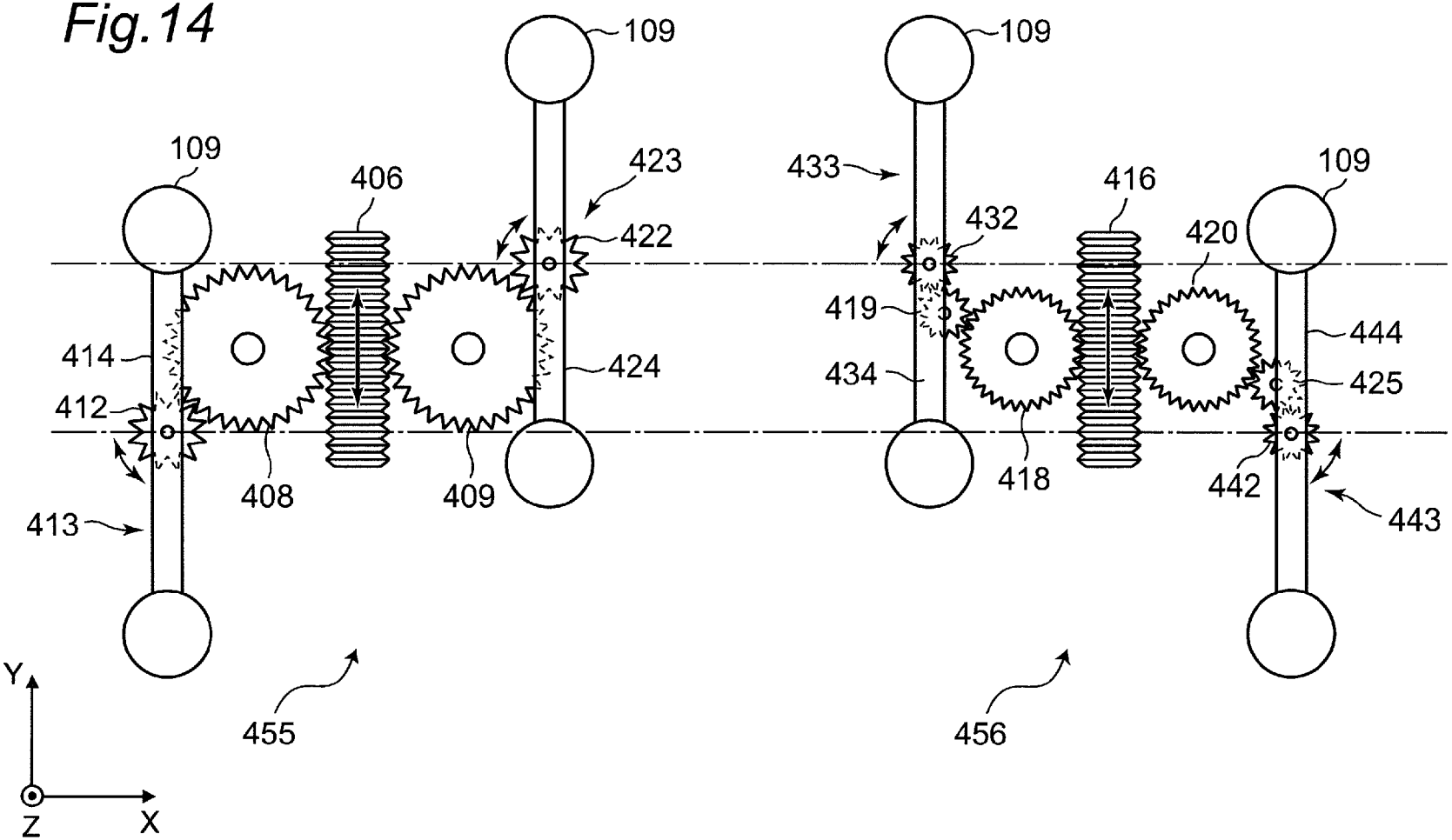
FIG. 14 is a view showing a configuration of a second main section of the drive mechanism of the rear-head washing unit in the automatic head washing device in accordance with the first embodiment.

FIG. 14 is a view showing a configuration of a second main section of the drive mechanism of the rear-head washing unit in the automatic head washing device in accordance with the first embodiment. FIG. 14 schematically shows the cylindrical racks 406 and 416, the gears 412, 422, 432, and 442 of the contact units 413, 423, 433, and 443, the fourth arms 414, 424, 434, and 444, the contacts 109, and the intermediate gears 408, 409, 418, 419, 420, and 425, in the rear-head washing unit 112 when viewed from the person's rear head 10*b*. FIG. 14 shows the linear third arms 407 and 417.

As described above, the central axes of the gears 412 and 422 of the contact units 413 and 423 disposed across the cylindrical rack 406 are offset from each other in the axial direction of the cylindrical rack 406. The central axes of the gears 432 and 442 of the contact units 433 and 443 disposed across the cylindrical rack 416 are offset from each other in the axial direction of the cylindrical rack 416. The central axes of the gears 412 and 442 of the contact units 413 and 443 are located at the same level in the axial directions of the cylindrical racks 406 and 416. The central axes of the gears 422 and 432 of the contact units 423 and 433 are located at the same level in the axial directions of the cylindrical racks 406 and 416. In this embodiment, by alternately disposing the contacts 109 to be offset from each other in the rear-head care unit 440, rear head can be washed more reliably. Since the rear-head washing unit 112 requires a structure supporting the weight of the person's head 10, a smaller amplitude of the rear-head washing unit 112 in the directions of the arrow 112*a* in FIG. 10A may exert a smaller stress on the person's head 10. For this reason, by increasing the density of the contacts 109 to be alternately disposed as shown in FIG. 16B, unwashed spots can be reduced while suppressing the amplitude of the rear-head washing unit 112 in the directions of the arrow 112*a*.

As shown in FIG. 14, when the cylindrical rack 406 moves in its axial direction by the rotation output of the motor 401, the gears 412 and 422 of the contact units 413 and 423 rotate in opposite directions via the intermediate gears 408 and 409, thereby causing the two contacts 109 attached to the gear 412 and the two contacts 109 attached to the gear 423 to rotate in opposite directions.

When the cylindrical rack 416 moves in its axial direction by the rotation output of the motor 401, the gears 432 and 442 of the contact units 433 and 443 rotate in opposite directions via the intermediate gears 418, 419, 420, and 425, thereby causing the two contacts 109 attached to the gear 432 and the two contacts 109 attached to the gear 442 to rotate in opposite directions. The contact units 413, 423, 433, and 443 are attached to the third arms 407 and 417 such that the fourth arms 414, 424, 434, and 444 extends parallel to the axial directions of the cylindrical racks 406 and 416, and the fourth arms 414, 424, 434, and 444 are disposed at substantially uniform intervals.

Figure 15A:
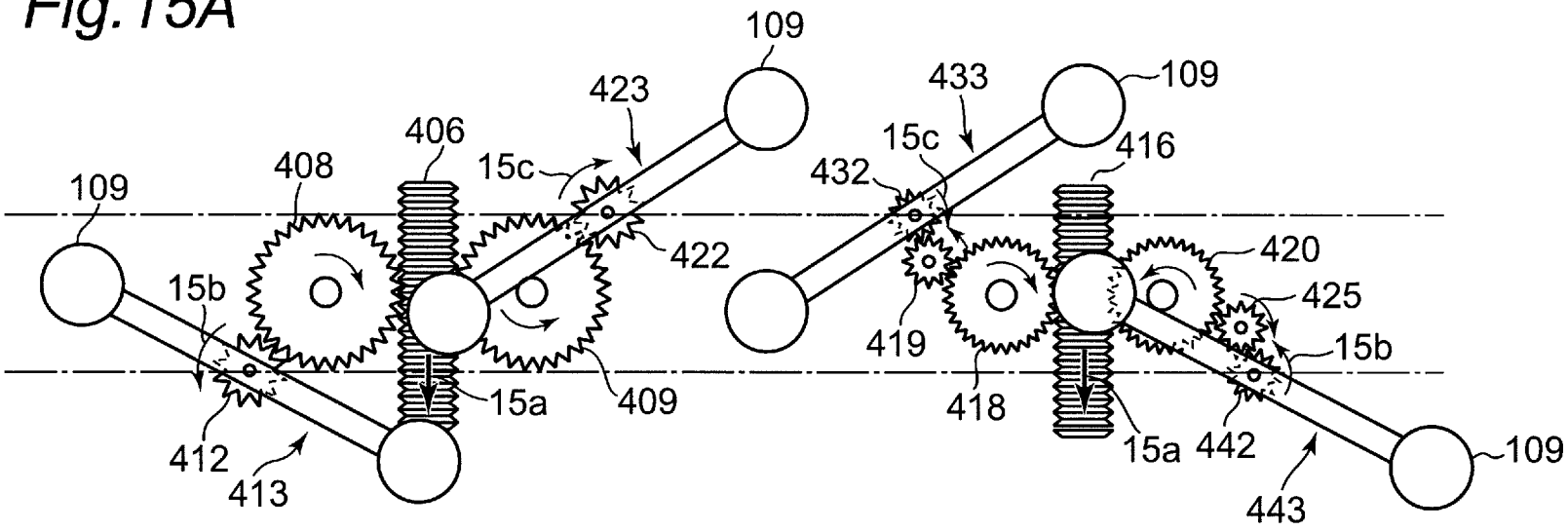
FIG. 15A is a view showing an operation of the second main section of the drive mechanism of the rear-head washing unit in the automatic head washing device in accordance with the first embodiment.
Figure 15B:
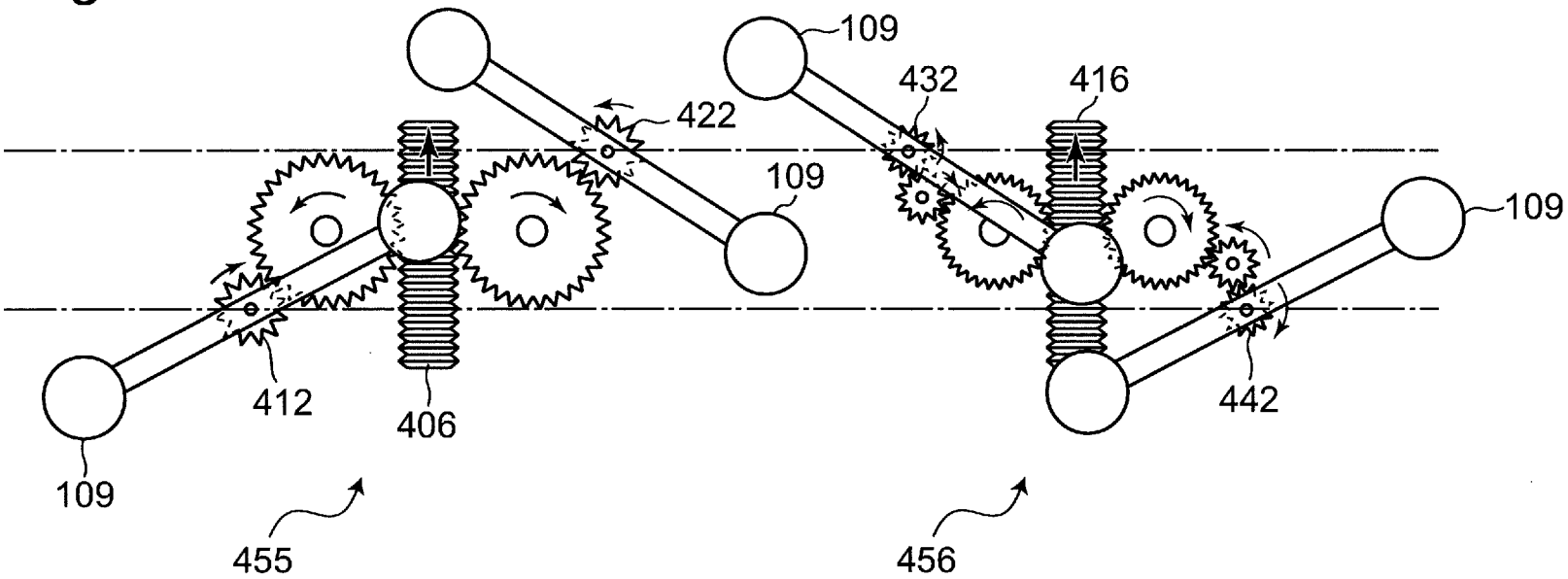
FIG. 15B is a view showing an operation of the second main section of the drive mechanism of the rear-head washing unit in the automatic head washing device in accordance with the first embodiment.

FIG. 15A and FIG. 15B are views showing the operation of the second main section of the drive mechanism of the rear-head washing unit in the automatic head washing device in accordance with the first embodiment. As shown in FIG. 15A, when the cylindrical rack 406 moves in the direction of an arrow 15*a*, the gears 412 and 422 of the contact units 413 and 423 rotate in opposite directions, i.e., in directions of arrows 15*b* and 15*c* via the gears 408 and 409, respectively. With this rotation, the contacts 109 attached to the gear 412 and the contacts 109 attached to the gear 422 rotate in opposite directions.

When the cylindrical rack 406 moves in the direction of the arrow 15*a*, the cylindrical rack 416 moves in the direction of the arrow 15*a*. When the cylindrical rack 416 moves in the direction of the arrow 15*a*, the gear 432 of the contact unit 433 rotates in the direction of the arrow 15*c* via the gears 418 and 419, and the gear 442 of the contact unit 443 rotates in the direction of the arrow 15*b* via the gears 420 and 425, resulting in that the gears 432 and 442 rotate in opposite directions. Accordingly, the contacts 109 attached to the gear 432 and the contacts 109 attached to the gear 442 rotate in opposite directions.

When the cylindrical racks 406 and 416 move in the direction of the arrow 15*a*, the gear 422 rotates in the direction of the arrow 15*c* and the gear 432 rotates in the direction of the arrow 15*c*. Thus, the gears 422 and 432 of the contact units 423 and 433 attached to the different third arms 407 and 417, respectively, the gears adjacent to each other without placing the cylindrical racks 406 and 416 therebetween, rotate in the same direction. By rotating the contact units 423 and 433 adjacent to each other without placing the cylindrical racks 406 and 416 therebetween in the same direction, even when the interval between the contact units 423 and 433 is decreased, the contacts 109 of the contact unit 423 do not hit against the contacts 109 of the contact unit 433.

When the cylindrical racks 406 and 416 move in the direction of the arrow 15*a*, the two contacts 109 (for example, the contact 109 of the contact unit 413 and the contact 109 of the contact unit 423) adjacent to each other in the direction orthogonal to the axial directions of the cylindrical racks 406 and 416 across the cylindrical racks 406 and 416 move to be closer to or away from each other. When the cylindrical racks 406 and 416 are moved in the direction of the arrow 15*a* in the state where the contacts 109 are in contact with the person's rear head 10*b*, the contacts 109 can rub the person's rear head 10*b*.

As shown in FIG. 15B, when the cylindrical racks 406 and 416 are moved in the direction opposite to the direction of the arrow 15*a*, the gears 412, 422, 432, and 442 and the contacts 109 each moves in the direction opposite to the operating direction in FIG. 15A. In the rear-head washing unit 112, the state in FIG. 15A and the state in FIG. 15B are alternately repeated, thereby oscillating the contacts 109 to perform the rubbing operation with the contacts 109.

With reference to FIG. 16A, FIG. 16B, FIG. 16C, FIG. 17A, FIG. 17B, and FIG. 17C, the rear-head washing unit 112 will be further described.

Figure 16A:
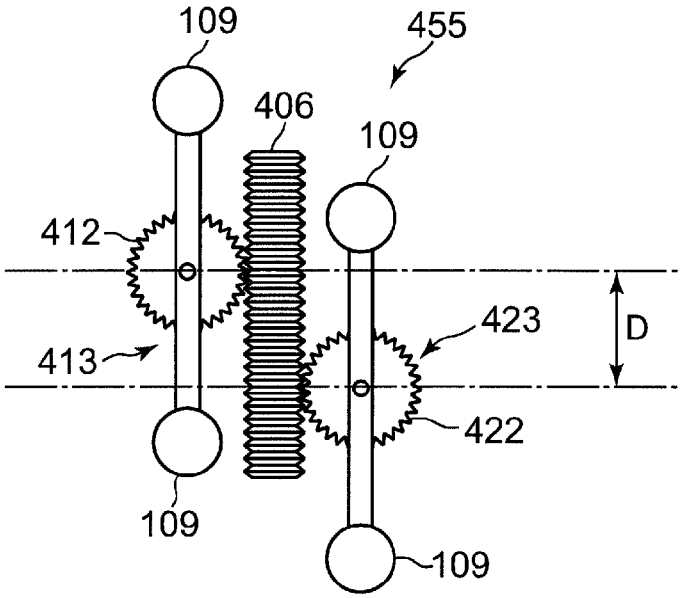
FIG. 16A is a view showing an operation of contact units offset from each other in the axial direction of a cylindrical rack in the rear-head washing unit.
Figure 16B:
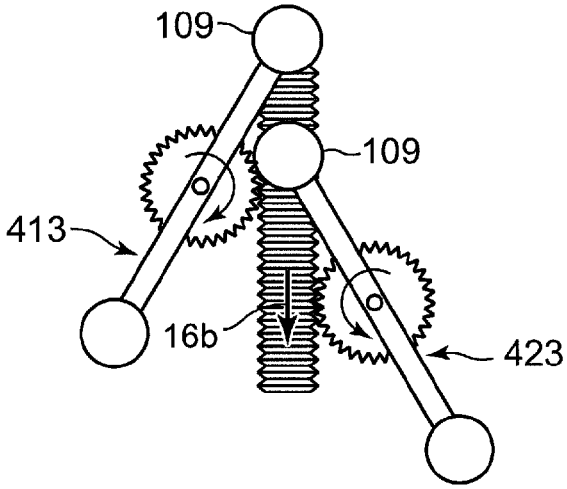
FIG. 16B is a view showing an operation of the contact units offset from each other in the axial direction of the cylindrical rack in the rear-head washing unit.
Figure 16C:
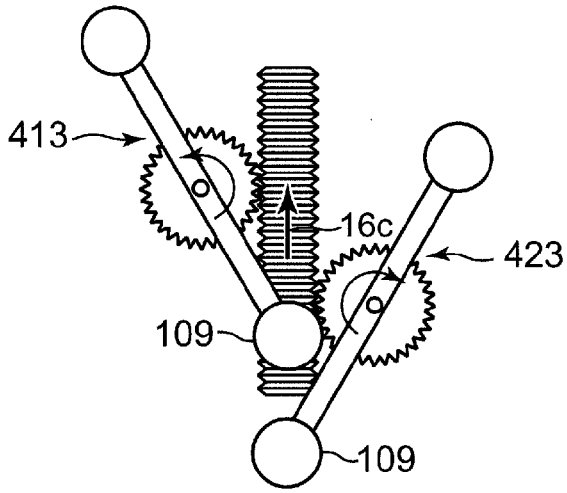
FIG. 16C is a view showing an operation of the contact units offset from each other in the axial direction of the cylindrical rack in the rear-head washing unit.

FIG. 16A, FIG. 16B, and FIG. 16C are views showing the operation of the two contact units offset from each other in the axial direction of the cylindrical rack in the rear-head washing unit. FIG. 16A, FIG. 16B, and FIG. 16C show a main section of the split unit 455. To be easy to understand, FIG. 16A, FIG. 16B, FIG. 16C show the case where the gears 412 and 422 of the contact units 413 and 423 directly engage with the cylindrical rack 406.

As shown in FIG. 16A, the central axes of the gear 412 and 422 of the contact units 413 and 423 disposed across the cylindrical rack 406 are offset from each other in the axial direction of the cylindrical rack 406 by a predetermined distance D. With this configuration, as shown in FIG. 16B and FIG. 16C, when the cylindrical rack 406 moves in directions of arrows 16*b* and 16*c*, in the case where the gears 412 and 422 rotate in opposite directions, the contact 109 of the contact unit 413 and the contact 109 of the contact unit 423 can be prevented from interfering with each other, so as to overlap in the direction orthogonal to the axial direction of the cylindrical rack 406. This can prevent unwashed spots between the contact units 413 and 423.

Figure 17A:
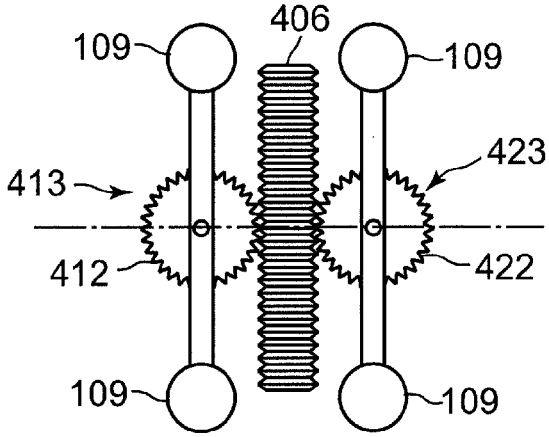
FIG. 17A is a view showing an operation of the contact units located at the same level in the axial direction of the cylindrical rack in the rear-head washing unit.
Figure 17B:
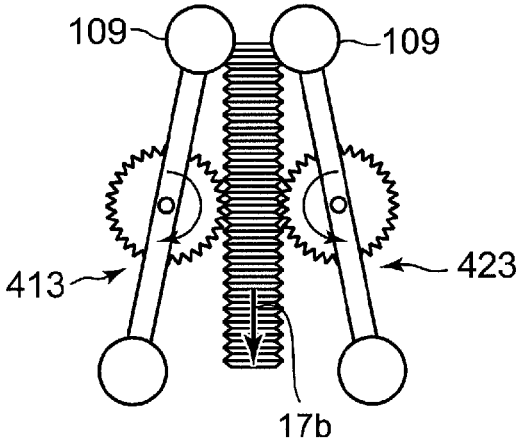
FIG. 17B is a view showing an operation of the contact units located at the same level in the axial direction of the cylindrical rack in the rear-head washing unit.
Figure 17C:
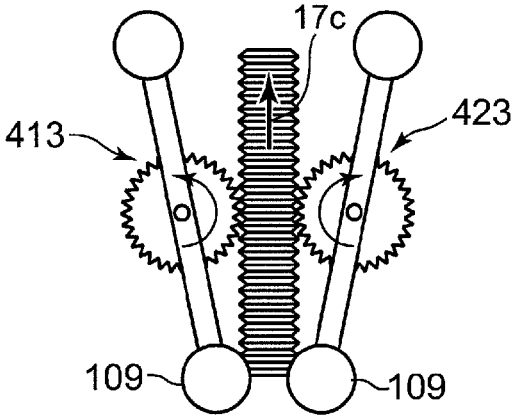
FIG. 17C is a view showing an operation of the contact units located at the same level in the axial direction of the cylindrical rack in the rear-head washing unit.

FIG. 17A, FIG. 17B, and FIG. 17C are views showing the operation of the two contact units located at the same level in the axial direction of the cylindrical rack in the rear-head washing unit. As shown in FIG. 17A, in the case where the central axes of the gears 412 and 422 of the contact units 413 and 423 disposed across the cylindrical rack 406 are located at the same level in the axial direction of the cylindrical rack 406, the contacts 109 of the contact unit 413 and the contacts 109 of the contact unit 423 are located at the same level in the axial direction of the cylindrical rack 406.

Supposing that the contacts 109 of the contact unit 413 and the contacts 109 of the contact unit 423 are located at the same level in the axial direction of the cylindrical rack 406. In this case, as shown in FIG. 17B and FIG. 17C, when the cylindrical rack 406 moves in directions of arrows 17*b* and 17*c*, the gears 412 and 422 rotate in opposite directions, and the rotation angle of the gears 412 and 422 are controlled such that the contacts 109 of the contact units 413 and 423 do not interfere with each other. Thus, unwashed spots may occur between the contact units 413 and 423. In this embodiment, since the central axes of the gears 412 and 422 of the contact units 413 and 423 disposed across the cylindrical rack 406 are offset from each other in the axial direction of the cylindrical rack 406, preventing the occurrence of unwashed spots between the contact units 413 and 423.

As shown in FIG. 15A and FIG. 15B, in the split unit 455, the central axes of the gears 412 and 422 of the contact units 413 and 423 are offset from each other in the axial direction of the cylindrical rack 406, and the gears rotate in opposite directions. Thereby, the contacts 109 of the contact units 413 and 423 can be prevented from interfering with each other, and can overlap each other in the direction orthogonal to the axial direction of the cylindrical rack 406, preventing the occurrence of unwashed spots between the contact units 413 and 423.

Similarly, in the split unit 456, the central axes of the gears 432 and 442 of the contact units 433 and 443 are offset from each other in the axial direction of the cylindrical rack 416, and the gears rotate in opposite directions. Thereby, the contacts 109 of the contact units 433 and 443 can be prevented from interfering with each other, and can overlap each other in the direction orthogonal to the axial direction of the cylindrical rack 416, preventing the occurrence of unwashed spots between the contact units 433 and 443.

The gears 422 and 432 of the adjacent contact units 423 and 433 held by the third arms 407 and 417 of the different split units 455 and 456, respectively, are located at the same level in the axial directions of the cylindrical racks 406 and 416, and rotate in the same direction and in the same phase. Thereby, the contacts 109 of the contact units 423 and 433 can be prevented from interfering with each other, and can overlap each other in the direction orthogonal to the axial directions of the cylindrical racks 406 and 416, preventing the occurrence of unwashed spots between the contact units 423 and 433.

The rear-head care unit 440 includes the contact units 413, 423, 433, and 443, the third arms 407 and 417 rotatably holding the contact units 413, 423, 433, and 443, the cylindrical racks 406 and 416, and the motor 401 oscillating the contacts 109 of the contact units 413, 423, 433, and 443. The motor 401 moves the cylindrical racks 406 and 416 in the axial directions of the cylindrical racks 406 and 416, and rotates the gears 412, 422, 432, and 442 of the contact units 413, 423, 433, and 443 to oscillate the contacts 109.

In the rear-head washing unit 112, like in the washing units 12, the housing 112H is provided with a pipe having a plurality of nozzles ejecting at least one of water, hot water, washing agent, and conditioner. Like the nozzles 110 of the above-mentioned washing units 12, the nozzles of the rear-head washing unit 112 can eject water, hot water, mousse-like washing agent, or conditioner. The rear-head washing unit 112 includes the water supplying unit supplying water or hot water, the washing agent supplying unit supplying washing agent, and the conditioner supplying unit supplying conditioner.

The control device 700 of the automatic head washing device 100 controls the operation of the water system valve, the washing agent system valve or the conditioner system valve ejecting water, hot water, mousse-like washing agent, or conditioner to the rear-head washing unit 112, and movement of the housing 112H of the rear-head washing unit 112. The control device 700 of the automatic head washing device 100 controls driving of the motor 401 moving the cylindrical racks 406 and 416 in the axial directions of the cylindrical racks 406 and 416.

The control device 700 brings the plurality of contacts 109 of the rear-head washing unit 112 into contact with the person's rear head 10*b* and drives the motor 401 in the state where water, hot water, mousse-like washing agent, or conditioner is ejected from the nozzles of the rear-head washing unit 112 and the washing units 12 supports the person's head 10, thereby oscillating the plurality of contacts 109. In this manner, the automatic head washing device 100 washes the person's rear head 10*b* supported by the head support 11 of the rear-head washing unit 112.

As described above, the rear-head washing unit 112 of the automatic head washing device 100 has the contact units 413, 423, 433, and 443, the third arms 407 and 417 rotatably holding the contact units 413, 423, 433, and 443, the cylindrical racks 406 and 416, and the motor 401 oscillating the plurality of contacts 109 of the contact units 413, 423, 433, and 443. The central axes of the gears 412 and 422 of the contact units 413 and 423 disposed across the cylindrical rack 406 are offset from each other in the axial direction of the cylindrical rack 406, and the central axes of the gears 432 and 442 of the contact units 433 and 443 disposed across the cylindrical rack 416 are offset from each other in the axial direction of the cylindrical rack 416. The contact units 413 and 443 are an example of a first contact unit. The contact units 423 and 433 are an example of the second contact unit. The third arms 407 and 417 are an example of a holding stage. The motor 401 is an example of an oscillating actuator. The gears 412, 422, 432, and 442 are an example of a rotation gear.

To limit the opening angle between the pair of V-shaped branches of the contact unit 413, 423, 433 or 443, the rear-head washing unit 112 may be provided with a support section G supporting the contacts 109 as represented by a chain double-dashed line in FIG. 11. By providing the support section G, when being used as the support, the rear-head washing unit 112 can support the person's rear head 10*b* more stably.

Second Embodiment

Next, a rear-head washing unit in an automatic head washing device in accordance with a second embodiment of the present invention will be described. Only differences between the rear-head washing unit in the automatic head washing device in accordance with the second embodiment of the present invention and the rear-head washing unit of the automatic head washing device 100 in accordance with the first embodiment will be described. The same constituents as those in the rear-head washing unit in the automatic head washing device 100 are given the same reference symbols and description thereof is omitted.

Figure 18:
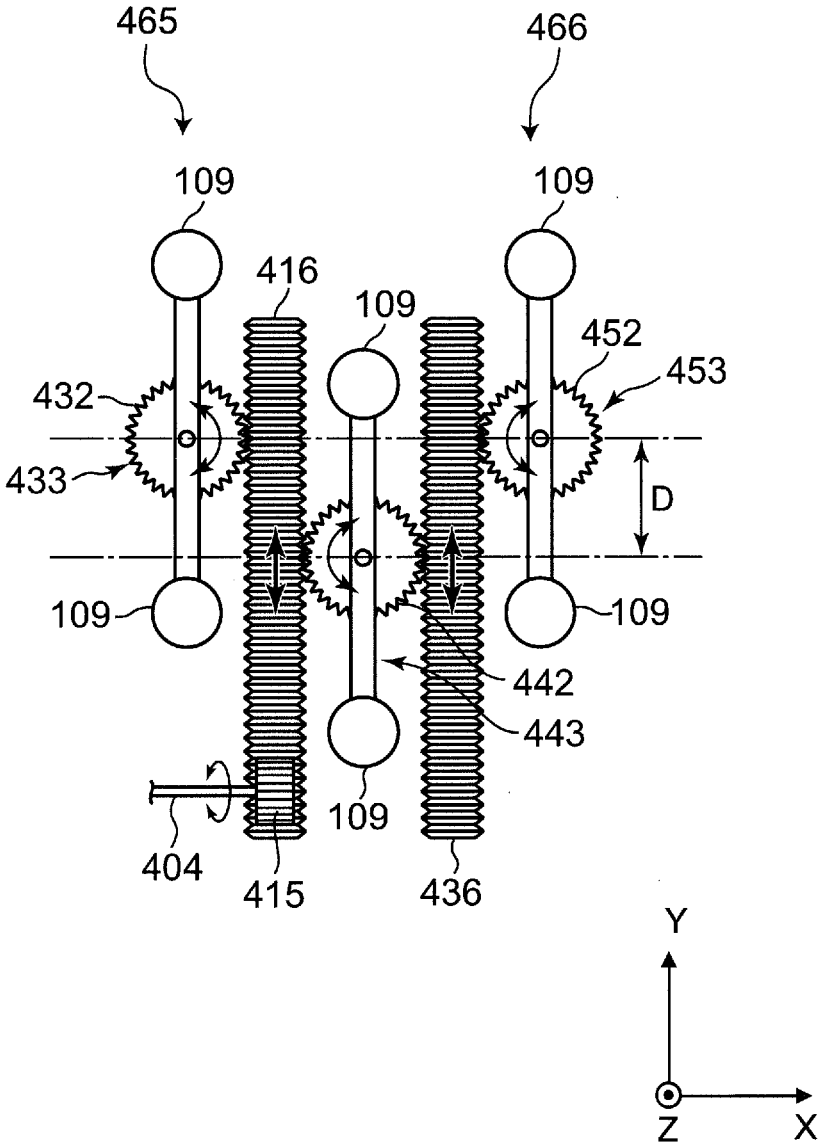
FIG. 18 is a plan view showing a main section of a drive mechanism of a rear-head washing unit in an automatic head washing device in accordance with a second embodiment of the present invention.
Figure 19:
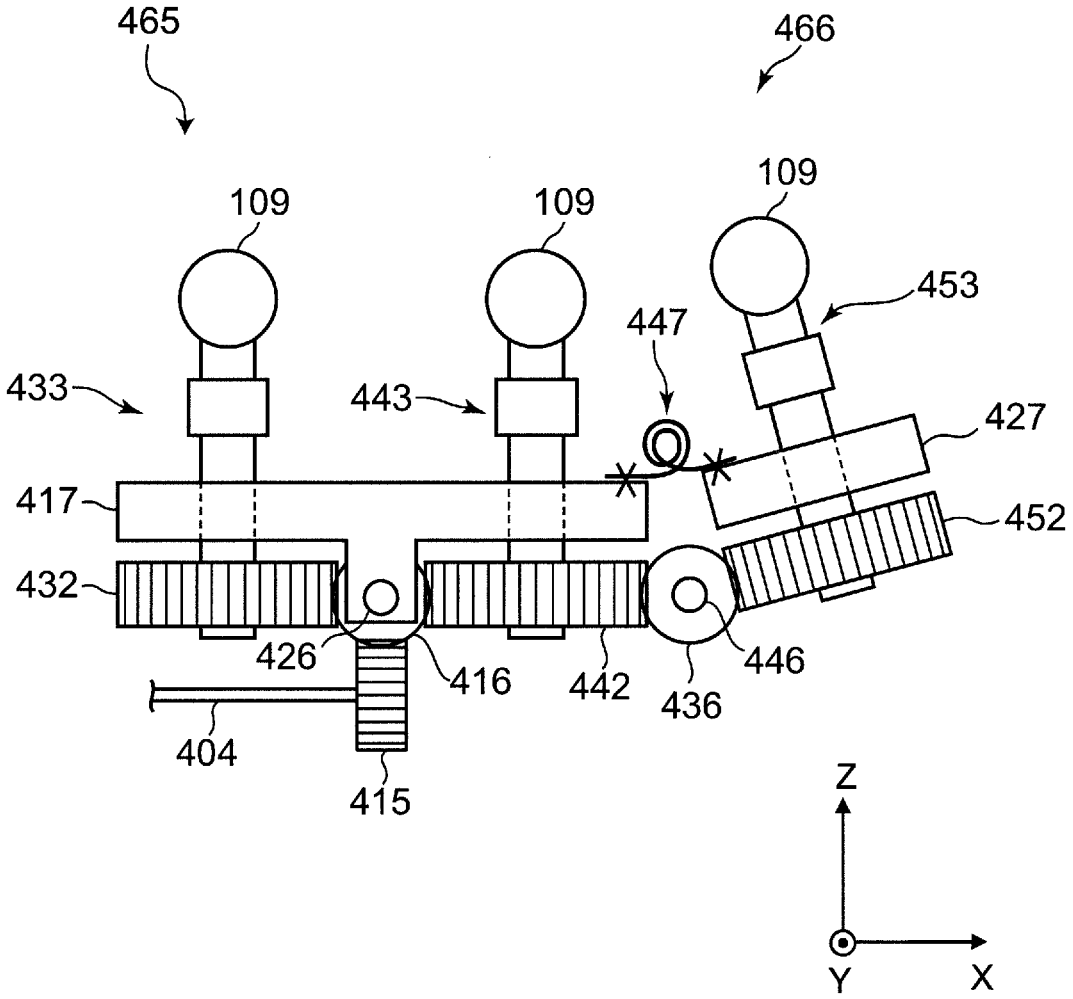
FIG. 19 is a side view showing the main section of the drive mechanism of the rear-head washing unit in the automatic head washing device in accordance with the second embodiment.

FIG. 18 is a plan view showing a main section of a drive mechanism of the rear-head washing unit in the automatic head washing device in accordance with the second embodiment of the present invention. FIG. 19 is a side view showing the main section of the drive mechanism of the rear-head washing unit in the automatic head washing device in accordance with the second embodiment. Although FIG. 18 and FIG. 19 show the state where the gears 432 and 442 of the contact units 433 and 443 are directly engaged with the cylindrical rack 416, as in the rear-head washing unit 112, intermediate gears may be provided between the gears 432 and 442 and the cylindrical rack 416. FIG. 19 shows the linear third arm 417.

As shown in FIG. 18 and FIG. 19, the rear-head washing unit in the automatic head washing device in accordance with the second embodiment includes a split unit 465 and a split unit 466. The split unit 466 includes a contact unit 453 that is different from the contact units 433 and 443, an auxiliary arm 427 rotatably holding the contact unit 453, and a cylindrical rack 436 that is different from the cylindrical rack 416.

The split unit 465 includes the contact units 433 and 443, the third arm 417 rotatably holding the contact units 433 and 443, and the cylindrical rack 416 rotating the gears 432 and 442 of the contact units 433 and 443 in opposite directions. The central axes of the gear 432 and 442 of the contact units 433 and 443 are offset from each other in the axial direction of the cylindrical rack 416 by the predetermined distance D.

As shown in FIG. 19, the split unit 465 has a wound spring 447 coupling the third arm 417 to the auxiliary arm 427. The auxiliary arm 427 is inclined toward the head support 11 with respect to the third arm 417 by the elastic force of the wound spring 447. The wound spring 447 is an example of an elastic member.

The cylindrical rack 436 having the same configuration as that of the cylindrical rack 416 is disposed between the contact unit 443 held by the third arm 417 and the contact unit 453 held by the auxiliary arm 427 so as to engage with the gear 442 of the contact unit 443 and the gear 452 of the contact unit 453. The cylindrical rack 436 is disposed such that its central axis is parallel to the central axis of the cylindrical rack 416, and is held by a support shaft 446 supported by the housing 112H to be movable in the axial direction of the cylindrical rack 436.

The central axes of the gears 442 and 452 of the contact units 443 and 453 disposed across the cylindrical rack 436 are offset from each other in the axial direction of the cylindrical rack 436 by the predetermined distance D. The central axes of the gears 432 and 452 of the contact units 433 and 453 are located at the same level in the axial direction of the cylindrical racks 416 and 436.

As shown in FIG. 18, when the drive shaft 404 is driven by the motor 401, the cylindrical rack 416 moves in the axial direction of the cylindrical rack 416 via the gear 415 attached to the drive shaft 404. When the cylindrical rack 416 moves in its axial direction, the gears 432 and 442 of the contact units 433 and 443 disposed across the cylindrical rack 416 rotate in opposite directions, thereby causing the two contacts 109 attached to the gear 432 and the two contacts 109 attached to the gear 442 to rotate in opposite directions.

When the gear 442 of the contact unit 443 rotates, the cylindrical rack 436 engaged with the gear 442 moves in the axial direction of the cylindrical rack 436, which is opposite to the direction in which the cylindrical rack 416 moves. When the cylindrical rack 436 moves in the axial direction of the cylindrical rack 436 via the gear 442, the gear 452 of the contact unit 453 rotates such that the gears 442 and 452 of the contact units 443 and 453 disposed across the cylindrical rack 436 rotate in the opposite directions, thereby causing the two contacts 109 attached to the gear 452 to rotate.

Figure 20A:
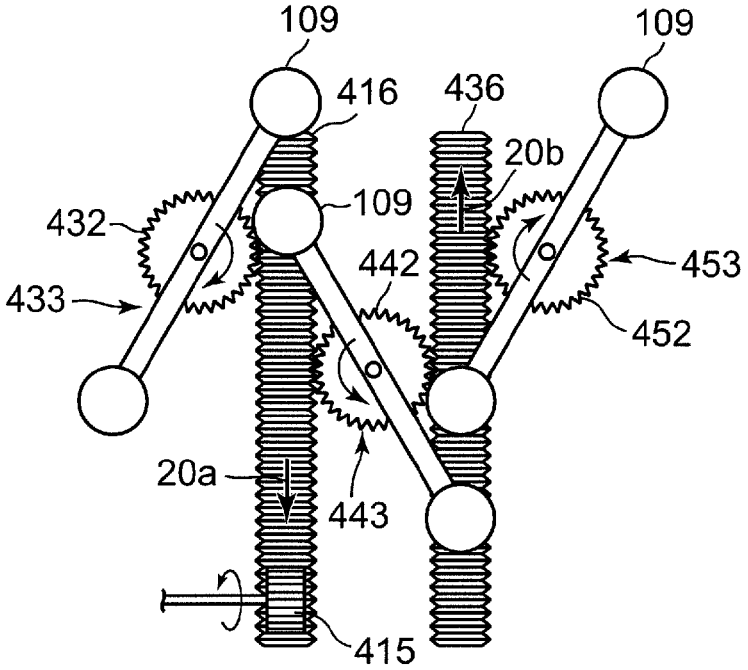
FIG. 20A is a view showing an operation of the main section of the drive mechanism of the rear-head washing unit in the automatic head washing device in accordance with the second embodiment.
Figure 20B:
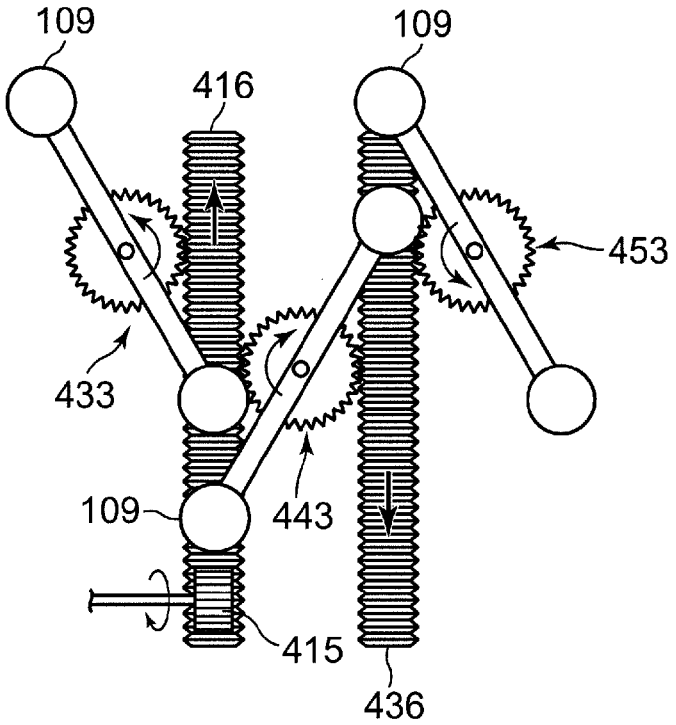
FIG. 20B is a view showing an operation of the main section of the drive mechanism of the rear-head washing unit in the automatic head washing device in accordance with the second embodiment.

FIG. 20A and FIG. 20B are views showing the operation of the main section of the drive mechanism of the rear-head washing unit in the automatic head washing device in accordance with the second embodiment. As shown in FIG. 20A, when the cylindrical rack 416 moves in the direction of an arrow 20*a*, the gears 432 and 442 of the contact units 433 and 443 disposed across the cylindrical rack 416 rotate in opposite directions and in this connection, the contacts 109 attached to the gear 432 and the contacts 109 attached to the gear 442 rotate in opposite directions. Since the central axes of the gears 432 and 442 are offset in the axial direction of the cylindrical rack 416, the contacts 109 of the contact unit 433 and the contacts 109 of the contact unit 443 can be prevented from interfering with each other, and overlap each other in the direction orthogonal to the axial direction of the cylindrical rack 416.

When the cylindrical rack 416 moves in the direction of the arrow 20*a*, the cylindrical rack 436 moves in the direction of an arrow 20*b* via the gear 442, and the gears 442 and 452 of the contact units 443 and 453 disposed across the cylindrical rack 436 rotate in opposite directions. With this connection, the contacts 109 attached to the gear 442 and the contacts 109 attached to the gear 452 rotate in opposite directions. Since the central axes of the gears 442 and 452 are offset from each other in the axial direction of the cylindrical rack 436, the contacts 109 of the contact unit 443 and the contacts 109 of the contact unit 453 can be prevented from interfering with each other, and can overlap each other in the direction orthogonal to the axial direction of the cylindrical rack 436.

As shown in FIG. 20B, when the cylindrical rack 416 is moved in the direction opposite to the direction of the arrow 20*a*, the gears 432 and 442 and the contacts 109 of the contact units 433 and 443 each move in the direction opposite to the operating direction shown in FIG. 20A. When the cylindrical rack 416 is moved in the direction opposite to the direction of the arrow 20*a*, the cylindrical rack 436 moves in the direction opposite to the direction of the arrow 20*b*, and the gear 452 and the contacts 109 of the contact unit 453 each move in the direction opposite to the operating direction shown in FIG. 20A.

In the rear-head washing unit in the automatic head washing device in accordance with the second embodiment, the state in FIG. 20A and the state in FIG. 20B may be alternately repeated in the state where water, hot water, mousse-like washing agent, or conditioner is ejected, thereby oscillating the contacts 109 to perform the rubbing operation with the contacts 109.

As described above, the rear-head washing unit in the second embodiment further includes the contact unit 453 that is different from the contact units 433 and 443, the auxiliary arm 427 holding the contact unit 453, and the cylindrical rack 436 that is different from the cylindrical rack 416. The central axes of the gears 442 and 452 of the contact units 443 and 453 disposed across the cylindrical rack 436 are offset from each other in the axial direction of the cylindrical rack 436, and the gears rotate in opposite directions. The contact unit 453 is an example of a third contact unit. The auxiliary arm 427 is an example of a second holding stage. The cylindrical rack 436 is an example of a second cylindrical rack.

Thereby, the contacts 109 of the contact units 443 and 453 disposed across the cylindrical rack 436 can be prevented from interfering with each other, and can overlap each other in the direction orthogonal to the axial direction of the cylindrical rack 436. Similarly, the contacts 109 of the contact units 433 and 443 disposed across the cylindrical rack 416 can be also prevented from interfering with each other. This can prevent the occurrence of unwashed spots among the contact units 433 and 443, 453.

Since the auxiliary arm 427 is inclined toward the head support 11 with respect to the third arm. 417 by the wound spring 447, the contacts 109 of the contact unit 453 held by the auxiliary arm. 427 can be brought into contact with the person's rear head 10*b* with a predetermined load. Thus, as compared to the rear-head washing unit in the first embodiment, the rear-head washing unit in the second embodiment can be disposed along the shape of the person's rear head 10*b* more easily, and can wash the head in contact with the person's rear head 10*b* more reliably.

In this embodiment, in the split unit 466, the cylindrical rack 436 is configured to engage with the gear 442 of the contact unit 443, and the central axes of the gears of the contact units 443 and 453 disposed across the cylindrical rack 436 are offset from each other in the axial direction of the cylindrical rack 436. The cylindrical rack 436 and the contact unit 453 may be provided on the side of the gear 432 of the contact unit 433. In this case, the central axes of the contact units 433 and 453 disposed across the cylindrical rack 436 are offset from each other in the axial direction of the cylindrical rack 436.

In the split unit 455 of the rear-head washing unit, the contact unit having the same configuration as that of the contact units 413 and 423, the auxiliary arm that rotatably holds the contact unit and is coupled to the third arm 407 with the wound spring, and the cylindrical rack having the same configuration as that of the cylindrical rack 406 disposed between the contact units 413 and 423 and the contact unit held by the auxiliary arm may be provided, and the central axes of the gears 412 and 422 of the contact units 413 and 423 and the central axis of the gear of the contact unit held by the auxiliary arm may be offset from each other in the axial direction of the cylindrical rack.

Third Embodiment

Next, a rear-head washing unit in an automatic head washing device in accordance with a third embodiment of the present invention will be described. Only differences between the rear-head washing unit in the automatic head washing device in accordance with the third embodiment and the rear-head washing unit 112 of the automatic head washing device 100 in accordance with the first embodiment will be described. The same constituents are given the same reference symbols and description thereof is omitted.

Figure 21A:
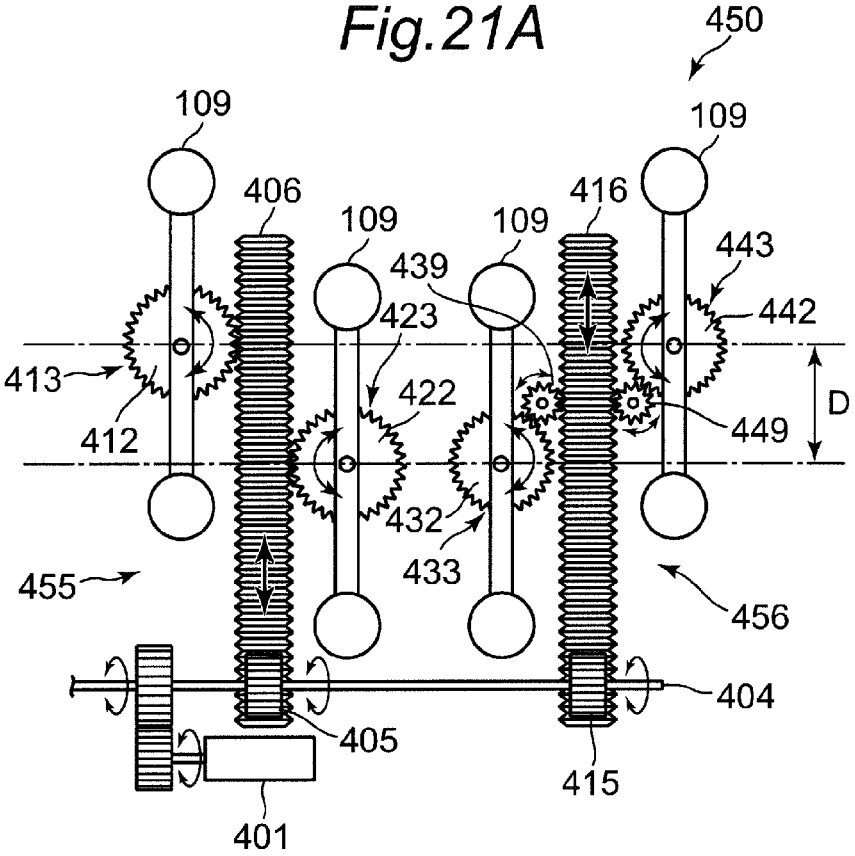
FIG. 21A is a view showing a main section of a drive mechanism of the rear-head washing unit in an automatic head washing device in accordance with a third embodiment of the present invention.
Figure 21B:
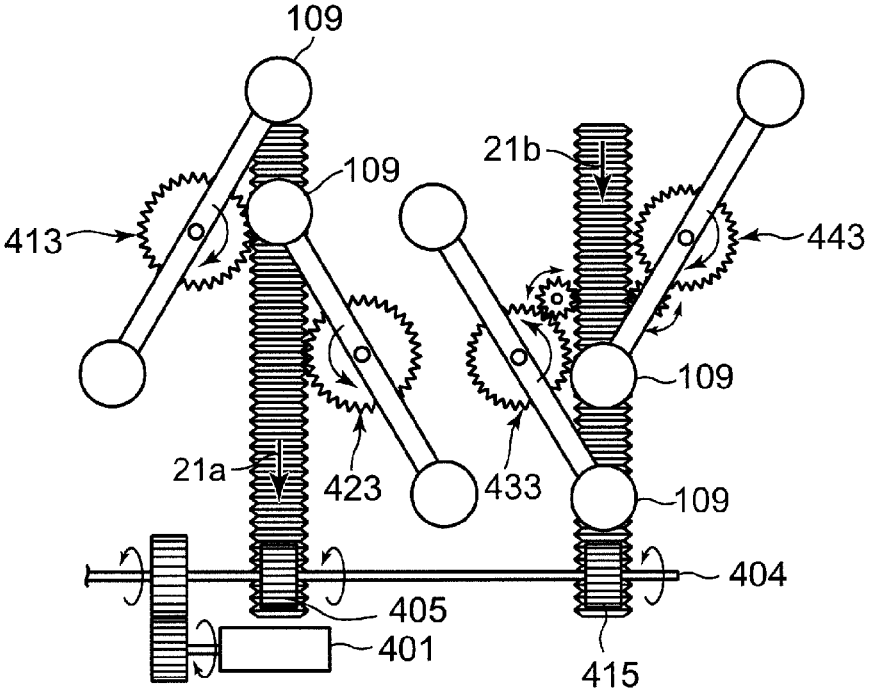
FIG. 21B is a view showing the main section of the drive mechanism of the rear-head washing unit in the automatic head washing device in accordance with the third embodiment.

FIG. 21A and FIG. 21B are views showing a main section of a drive mechanism of the rear-head washing unit in the automatic head washing device in accordance with the third embodiment of the present invention. As shown in FIG. 21A, in a rear-head care unit 450 in the automatic head washing device in accordance with the third embodiment, the gears 412 and 422 of the contact units 413 and 423 disposed across the cylindrical rack 406 are directly engaged with the cylindrical rack 406, and the gears 432 and 442 of the contact units 433 and 443 disposed across the cylindrical rack 416 are engaged with the cylindrical rack 416 via intermediate gears 439 and 449, respectively.

The central axes of the gears 412 and 422 of the contact units 413 and 423 disposed across the cylindrical rack 406 are offset from each other in the axial direction of the cylindrical rack 406 by the predetermined distance D. The central axes of the gears 432 and 442 of the contact units 433 and 443 disposed across the cylindrical rack 416 are offset from each other in the axial direction of the cylindrical rack 416 by the predetermined distance D.

In the rear-head care unit 450, the central axes of the cylindrical racks 406 and 416 are parallel to each other, and the gears 422 and 432 of the adjacent contact units 423 and 433 held by the third arms 407 and 417 of the different split units 455 and 456, respectively, are located at the substantially same level in the axial directions of the cylindrical racks 406 and 416. The gears 412 and 442 of the contact units 413 and 443 are located at the substantially same level in the axial directions of the cylindrical racks 406 and 416.

As shown in FIG. 21B, when the cylindrical racks 406 and 416 move in the same direction of the directions of arrows 21*a* and 21*b* (axial directions of the cylindrical racks 406 and 416) via the gears 405 and 415 attached to the drive shaft 404 transmitting the output from the motor 401, the gears 412 and 422 of the contact units 413 and 423 disposed across the cylindrical rack 406 rotate in opposite directions, thereby causing the contacts 109 attached to the gear 412 and the contacts 109 attached to the gear 422 to rotate in opposite directions. Since the central axes of the gears 412 and 422 are offset from each other in the axial direction of the cylindrical rack 406, the contacts 109 of the contact unit 413 and the contacts 109 of the contact unit 423 can be prevented from interfering from each other, and can overlap each other in the direction orthogonal to the axial direction of the cylindrical rack 406.

The gears 432 and 442 of the contact units 433 and 443 disposed across the cylindrical rack 416 rotate in opposite directions, thereby causing the contacts 109 attached to the gear 432 and the contacts 109 attached to the gear 442 to rotate in opposite directions. Since the central axes of the gears 432 and 442 are offset from each other in the axial direction of the cylindrical rack 416, the contacts 109 of the contact unit 433 and the contacts 109 of the contact unit 443 can be prevented from interfering from each other, and can overlap each other in the direction orthogonal to the axial direction of the cylindrical rack 416.

When the cylindrical racks 406 and 416 move in the directions of the arrows 21*a* and 21*b*, the gears 422 and 432 of the adjacent contact units 423 and 433 held by the third arms 407 and 417 of the different split units 455 and 456, respectively, rotate in the same direction and in the same phase, and the contacts 109 attached to the gear 422 and the contacts 109 attached to the gear 432 can be prevented from interfering from each other, and can overlap each other in the direction orthogonal to the axial directions of the cylindrical racks 406 and 416.

When the cylindrical racks 406 and 416 are moved in directions opposite to the directions of the arrows 21*a* and 21*b*, the gears 412, 422, 432, and 442 and the contacts 109 of the contact units 413, 423, 433, and 443 each move in the direction opposite to the operating direction shown in FIG. 21B. Also in this embodiment, the state in FIG. 21B and the state in which the gears and so on are moved in the direction opposite to the operating direction in FIG. 21B may be alternately repeated, thereby oscillating the contacts 109 to perform the rubbing operation with the contacts 109.

As described above, the rear-head washing unit in the automatic head washing device in the third embodiment has the contact units 413, 423, 433, and 443, the third arms 407 and 417, the cylindrical racks 406 and 416, and the motor 401 oscillating the contacts 109 of the contact units 413, 423, 433, and 443. The central axes of the gears 412, 422, 432, and 442 of the contact units 413, 423, 433, and 443 are offset from each other in the axial directions of the cylindrical racks 406 and 416. Thereby, in washing the person's rear head 10*b*, the occurrence of unwashed spots can be prevented to reliably wash the person's rear head 10*b*.

The rear-head washing unit in this embodiment has the drive shaft 404 transmitting the output from the motor 401, the contact units 413 and 423, the third arms 407 and 417, and the cylindrical racks 406 and 416. In the rear-head washing unit in this embodiment, the central axes of the cylindrical racks 406 and 416 are parallel to each other, and the two split units 455 and 456 in which the cylindrical racks 406 and 416 move in the same axial directions via the gears 405 and 415 disposed at the drive shaft 404, respectively, are provided.

The rear-head washing unit in the third embodiment can be provided with a smaller number of gears than in the rear-head washing unit in the first embodiment, thereby making the structure simpler to improve its reliability. The rear-head washing unit in the third embodiment can also be minituarized.

Fourth Embodiment

Next, a rear-head washing unit in an automatic head washing device in accordance with a fourth embodiment of the present invention will be described. Only differences between the rear-head washing unit in the automatic head washing device in accordance with the fourth embodiment of the present invention and the rear-head washing unit in the automatic head washing device in accordance with the third embodiment will be described. The same constituents are given the same reference symbols and description thereof is omitted.

Figure 22A:
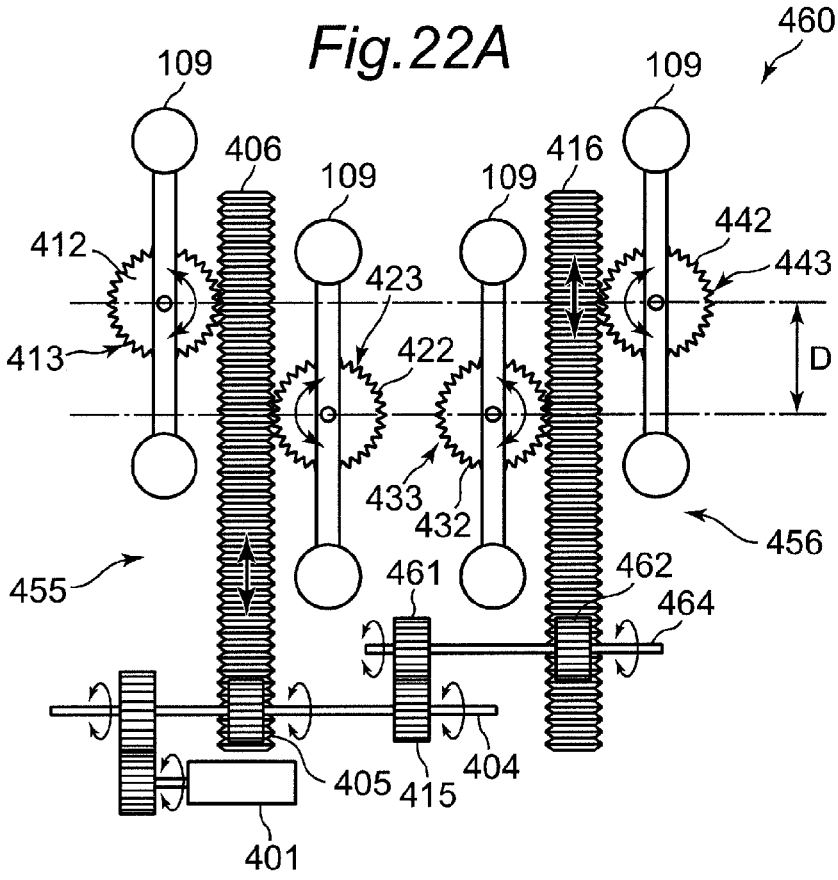
FIG. 22A is a view showing a main section of a drive mechanism of a rear-head washing unit in an automatic head washing device in accordance with a fourth embodiment of the present invention.
Figure 22B:
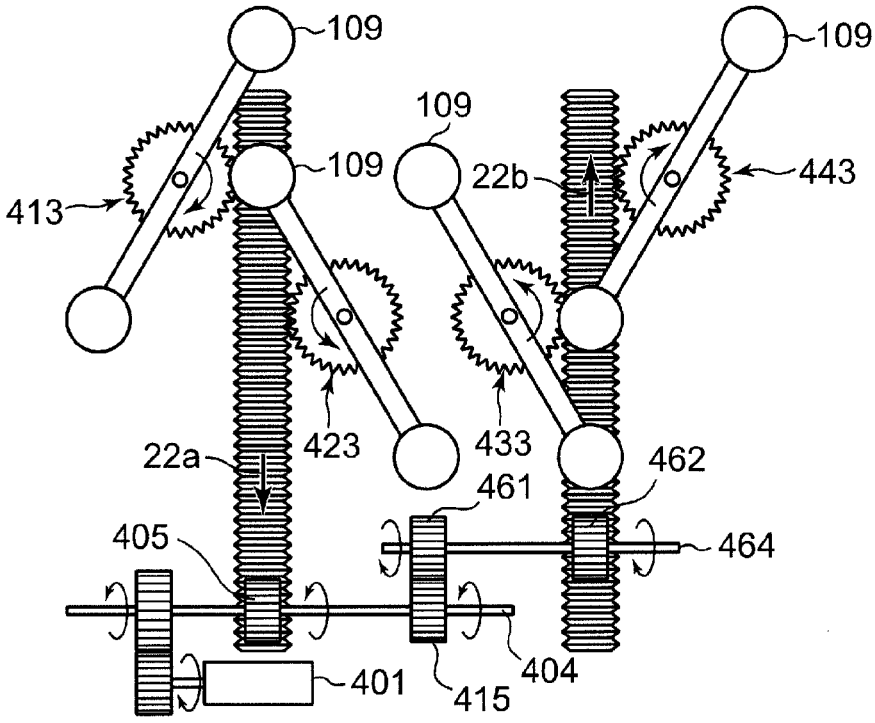
FIG. 22B is a view showing the main section of the drive mechanism of the rear-head washing unit in the automatic head washing device in accordance with the fourth embodiment.

FIG. 22A and FIG. 22B are views showing a main section of a drive mechanism of the rear-head washing unit in the automatic head washing device in accordance with the fourth embodiment of the present invention. As shown in FIG. 22A, in a rear-head care unit 460 of the rear-head washing unit in the automatic head washing device in accordance with the fourth embodiment, the gears 432 and 442 of the contact units 433 and 443 disposed across the cylindrical rack 416 in the rear-head care unit 450 in the third embodiment are directly engaged with the cylindrical rack 416, and rotation of the gear 415 attached to the drive shaft 404 is reversed by a drive shaft 464 and then, is transmitted to the cylindrical rack 416. A gear 461 engaged with the gear 415 and a gear 462 engaged with the cylindrical rack 416 are attached to the drive shaft 464.

The central axes of the gears 412 and 422 of the two contact units 413 and 423 disposed across the cylindrical rack 406 are offset from each other in the axial direction of the cylindrical rack 406 by the predetermined distance D. The central axes of the gears 432 and 442 of the two contact units 433 and 443 disposed across the cylindrical rack 416 are offset from each other in the axial direction of the cylindrical rack 416 by the predetermined distance D.

In the rear-head care unit 460, central axes of the cylindrical racks 406 and 416 are parallel to each other, and the gears 422 and 432 of the adjacent contact units 423 and 433 held by the third arms 407 and 417 of the different split units 455 and 456, respectively, are located at the substantially same level in the axial directions of the cylindrical racks 406 and 416. The gears 412 and 442 of the contact units 413 and 443 are located at the substantially same level in the axial directions of the cylindrical racks 406 and 416.

As shown in FIG. 22B, when the cylindrical rack 406 moves in the direction of an arrow 22*a* via the gear 405 attached to the drive shaft 404 transmitting the output from the motor 401, the gears 412 and 422 of the two contact units 413 and 423 disposed across the cylindrical rack 406 rotate in opposite directions, thereby causing the contacts 109 attached to the gear 412 and the contacts 109 attached to the gear 422 to rotate in opposite directions. Since the central axes of the gears 412 and 422 are offset from each other in the axial direction of the cylindrical rack 406, the contacts 109 of the contact unit 413 and the contacts 109 of the contact unit 423 can be prevented from interfering with each other, and can overlap each other in the direction orthogonal to the axial direction of the cylindrical rack 406.

When the cylindrical rack 406 moves in the direction of the arrow 22*a* via the gear 405, the cylindrical rack 416 moves in the direction of an arrow 22*b* that is different from the direction of the arrow 22*a* in the axial directions of the cylindrical racks 406 and 416 via the gear 462 attached to the drive shaft 464 transmitting the output from the motor 401. When the cylindrical rack 416 moves in the direction of the arrow 22*b*, the gears 432 and 442 of the two contact units 433 and 443 disposed across the cylindrical rack 416 rotate in opposite directions, thereby causing the contacts 109 attached to the gear 432 and the contacts 109 attached to the gear 442 to rotate in opposite directions. Since the central axes of the gears 432 and 442 are offset from each other in the axial direction of the cylindrical rack 416, the contacts 109 of the contact unit 433 and the contacts 109 of the contact unit 443 can be prevented from interfering with each other, and can overlap each other in the direction orthogonal to the axial direction of the cylindrical rack 406.

When the cylindrical racks 406 and 416 move in the directions of the arrows 22*a* and 22*b*, respectively, the gears 422 and 432 of the adjacent contact units 423 and 433 held by the third arms 407 and 417 of the different split units 455 and 456, respectively, rotate in the same direction and in the same phase, and the contacts 109 attached to the gear 422 and the contacts 109 attached to the gear 432 can be prevented from interfering from each other, and can overlap each other in the direction orthogonal to the axial directions of the cylindrical racks 406 and 416.

When the cylindrical racks 406 and 416 are moved in the directions opposite to the directions of the arrows 22*a* and 22*b*, respectively, the gears 412, 422, 432, and 442 and the contacts 109 of the contact units 413, 423, 433, and 443 each move in the direction opposite to the operating direction shown in FIG. 22B. Thus, also in this embodiment, the state in FIG. 22B and the state in which the gears and so on are moved in the direction opposite to the operating direction in FIG. 22B may be alternately repeated, thereby oscillating the contacts 109 to perform the rubbing operation with the contacts 109.

The rear-head washing unit in the fourth embodiment has the more complicated drive shaft mechanism but a smaller number of gears than in the rear-head washing unit in the third embodiment. Thus, as compared to the unit in the first embodiment, the structure can be made simpler to improve reliability. Moreover, the unit can be reduced in size. It is desirable to appropriately select the rear-head washing unit in the fourth embodiment or the rear-head washing unit in the third embodiment according to installation conditions, used components, and required durability.

Fifth Embodiment

Next, a rear-head washing unit in an automatic head washing device in accordance with a fifth embodiment of the present invention will be described. Only differences between the rear-head washing unit in the automatic head washing device in accordance with the fifth embodiment of the present invention and the rear-head washing unit in the automatic head washing device in accordance with the third embodiment will be described. The same constituents are given the same reference symbols and description thereof is omitted.

Figure 23A:
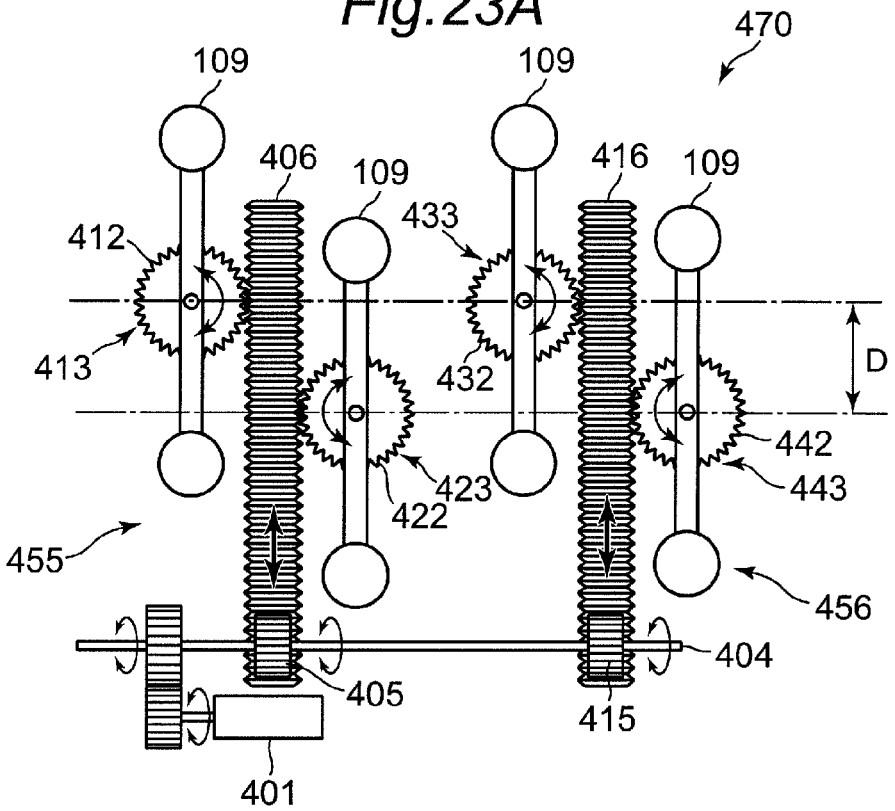
FIG. 23A is a view showing a main section of a drive mechanism of a rear-head washing unit in an automatic head washing device in accordance with a fifth embodiment of the present invention.
Figure 23B:
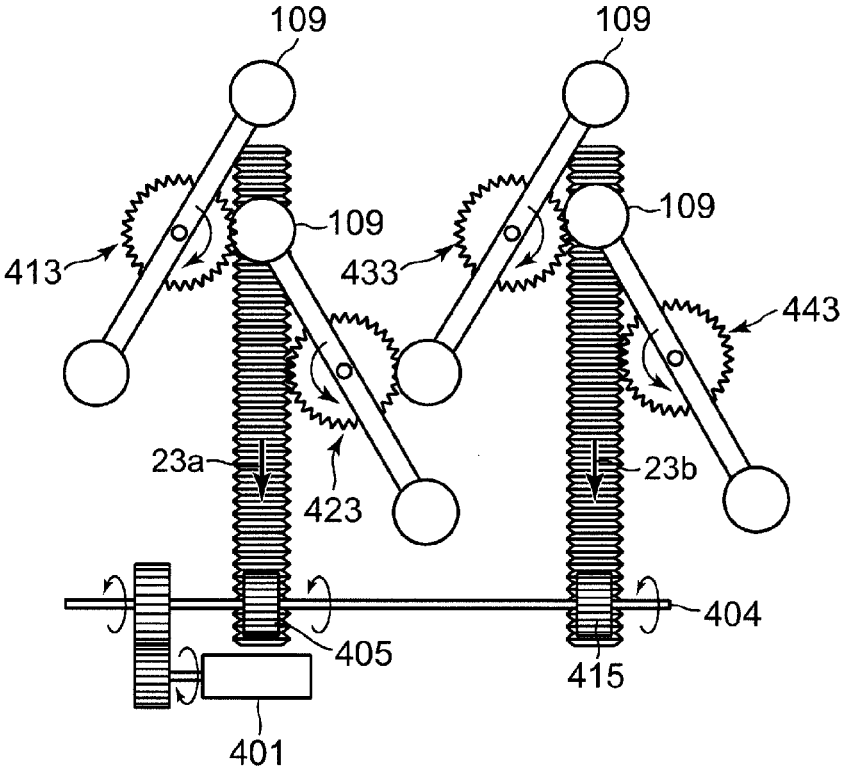
FIG. 23B is a view showing the main section of the drive mechanism of the rear-head washing unit in the automatic head washing device in accordance with the fifth embodiment.

FIG. 23A and FIG. 23B are views showing a main section of a drive mechanism of the rear-head washing unit in the automatic head washing device in accordance with the fifth embodiment of the present invention. As shown in FIG. 23A, in a rear-head care unit 470 of the rear-head washing unit in the automatic head washing device in accordance with the fifth embodiment, the gears 432 and 442 of the contact units 433 and 443 disposed across the cylindrical rack 416 in the rear-head care unit 450 in the third embodiment are directly engaged with the cylindrical rack 416. Further, in the rear-head care unit 470, the central axes of the gears 412 and 422 of the contact units 413 and 423 disposed across the cylindrical rack 406 and the central axes of the gears 432 and 442 of the contact units 433 and 443 disposed across the cylindrical rack 416 are located at the same level in the axial directions of the cylindrical racks 406 and 416, respectively.

The central axes of the gears 412 and 422 of the contact units 413 and 423 disposed across the cylindrical rack 406 are offset from each other in the axial direction of the cylindrical rack 406 by the predetermined distance D. Further, the central axes of the gears 432 and 442 of the two contact units 433 and 443 disposed across the cylindrical rack 416 are offset from each other in the axial direction of the cylindrical rack 416 by the predetermined distance D.

In the rear-head care unit 470, the central axes of the cylindrical racks 406 and 416 are parallel to each other, and the gears 422 and 432 of the adjacent contact units 423 and 433 held by the third arms 407 and 417 of the different split units 455 and 456, respectively, are offset in the axial directions of the cylindrical racks 406 and 416 by the predetermined distance D.

As shown in FIG. 23B, when the cylindrical rack 406 moves in the direction of an arrow 23*a* via the gear 405 attached to the drive shaft 404 transmitting the output from the motor 401, the gears 412 and 422 of the two contact units 413 and 423 disposed across the cylindrical rack 406 rotate in opposite directions, thereby causing the contacts 109 attached to the gear 412 and the contacts 109 attached to the gear 422 to rotate in opposite directions. Since the central axes of the gears 412 and 422 are offset from each other in the axial direction of the cylindrical rack 406, the contacts 109 of the contact unit 413 and the contacts 109 of the contact unit 423 can be prevented from interfering with each other, and can overlap each other in the direction orthogonal to the axial direction of the cylindrical rack 406.

When the cylindrical rack 406 moves in the direction of the arrow 23*a*, the cylindrical rack 416 moves in the direction of an arrow 23*b*, that is the same direction as the direction of the arrow 23*a* in the axial directions of the cylindrical racks 406 and 416, via the gear 415 attached to the drive shaft 404. When the cylindrical rack 416 moves in the direction of the arrow 23*b*, the gears 432 and 442 of the two contact units 433 and 443 disposed across the cylindrical rack 416 rotate in opposite directions, thereby causing the contacts 109 attached to the gear 432 and the contacts 109 attached to the gear 442 to rotate in opposite directions. Since the central axes of the gears 432 and 442 are offset from each other in the axial direction of the cylindrical rack 416, the contacts 109 of the contact unit 433 and the contacts 109 of the contact unit 443 can be prevented from interfering with each other, and can overlap each other in the direction orthogonal to the axial direction of the cylindrical rack 416.

When the cylindrical racks 406 and 416 move in the directions of arrows 23*a* and 23*b*, respectively, the gears 422 and 432 of the adjacent contact units 423 and 433 held by the third arms 407 and 417 of the different split units 455 and 456, respectively, rotate in opposite directions. Since the central axes of the gears 422 and 432 are offset from each other in the axial directions of the cylindrical racks 406 and 416, the contacts 109 of the contact unit 423 and the contacts 109 of the contact unit 433 can be prevented from interfering with each other, and can overlap each other in the direction orthogonal to the axial directions of the cylindrical racks 406 and 416.

When the cylindrical racks 406 and 416 are moved in the directions opposite to the directions of the arrows 23*a* and 23*b*, respectively, the gears 412, 422, 432, and 442 and the contacts 109 of the contact units 413, 423, 433, and 443 each move in the direction opposite to the operating direction shown in FIG. 23B. In this embodiment, the state in FIG. 23B and the state in which the gears and so on are moved in the direction opposite to the operating direction in FIG. 23B may be alternately repeated, thereby oscillating the contacts 109 to perform the rubbing operation with the contacts 109.

As described above, the rear-head washing unit in the automatic head washing device in accordance with the fifth embodiment has the contact units 413, 423, 433, and 443, the third arms 407 and 417, the cylindrical racks 406 and 416, and the motor 401 oscillating the contacts 109 of the contact units 413, 423, 433, and 443. The central axes of the gears 412, 422, 432, and 442 of the contact units 413, 423, 433, and 443 are offset from each other in the axial directions of the cylindrical racks 406 and 416. Thereby, in washing the person's rear head 10*b*, the occurrence of unwashed spots can be prevented to reliably wash the person's rear head 10*b*.

The rear-head washing unit in this embodiment has the drive shaft 404 transmitting the output of the motor 401, the contact units 413 and 423, the third arms 407 and 417, and the cylindrical racks 406 and 416. The rear-head washing unit includes the split units 455 and 456. In the split units 455 and 456, the central axes of the cylindrical racks 406 and 416 are parallel to each other, and the cylindrical racks 406 and 416 move in the same direction in the axial directions of the cylindrical racks 406 and 416 via the gears 405 and 415 disposed at the drive shaft 404, respectively.

The gears 422 and 432 of the adjacent contact units 423 and 433 held by the third arms 407 and 417 of the different split units 455 and 456 are offset from each other in the axial directions of the cylindrical racks 406 and 416, and rotate in opposite directions. Thereby, the contacts 109 of the adjacent contact units 423 and 433 held by the different third arms 407 and 417, respectively, can be prevented from interfering with each other, and can overlap each other in the direction orthogonal to the axial directions of the cylindrical racks 406 and 416. As a result, the occurrence of unwashed spots between the contact units 423 and 433 can be prevented.

In the automatic head washing devices in the third embodiment to the fifth embodiment, the third arm rotatably holding the contact units disposed across the cylindrical rack may be curved as shown in FIG. 11, or may be linear as shown in FIG. 7. An intermediate gear may be provided between the gear of the contact unit and the cylindrical rack.

INDUSTRIAL APPLICABILITY

An automatic head care device or an automatic head washing device according to the present invention can be widely used in the industry of beauty care and hairdressing as well as in the medical field of nursing care, which is useful.

DESCRIPTION OF REFERENCE SYMBOLS

10 head
10*a* scalp
10*b* rear head
11 head support
12 washing unit
12L left washing unit
12R right washing unit
13, 413, 423, 433, 443, 453 contact unit
14, 455, 456, 465, 466 split unit
40 head care unit
100 automatic head washing device
101 bowl
101*a*, 112H housing
101*b* drain port
102L, 102R support column
103L, 103R arm base
104L, 104R, 212L, 212R, 213L, 213R, 214L, 215L, 410, 426, 446 support shaft
105L, 105R first arm
106L, 106R second arm
107L, 107R, 108L, 108R, 407, 417 third arm
109 contact
110 nozzle
111L, 111R pipe
112 rear-head washing unit
113 hood

115L, 115R arm housing
125 cover
201L, 206L, 201R, 206R, 301L, 401 motor
216 water system valve
217 washing agent system valve
218 conditioner system valve
220 mixing unit
222 washing agent supplying unit
304L, 404, 464 drive shaft
306La, 314La, 406*a*, 416*a* rack mechanism
306L, 314L, 406, 416, 436 cylindrical rack
309L, 310L, 317L, 320L, 414, 424, 434, 444 fourth arm
427 auxiliary arm
447 wound spring
440, 450, 460, 470 rear-head care unit
700 control device

The invention claimed is:

1. An automatic head care device comprising:

a base having a head support supporting a person's head; and a rear-head care unit attached to the base, the rear-head care unit caring a person's rear head, wherein the rear-head care unit includes:

first and second contact units, each unit having a rotation gear rotating a plurality of contacts provided at ends of the unit around a central axis of the rotation gear;

a holding stage rotatably holding the respective first and second contact units;

a cylindrical rack held between the first and second contact units to be movable in an axial direction of the cylindrical rack, the cylindrical rack moving in the axial direction to rotate the rotation gears of the first and second contact units in opposite directions; and an oscillating actuator oscillating the plurality of contacts of the first and second contact units by moving the cylindrical rack in the axial direction to rotate the rotation gears of the first and second contact units in opposite directions.

2. The automatic head care device according to claim 1, wherein the central axes of the rotation gears of the first and second contact units are offset from each other in the axial direction of the cylindrical rack.

3. The automatic head care device according to claim 1, wherein the rear-head care unit further includes:

a third contact unit having a rotation gear rotating a plurality of contacts at ends of the unit around a central axis of the rotation gear;

a second holding stage rotatably holding the third contact unit; and a second cylindrical rack held between the first or second contact unit and the third contact unit to be movable in an axial direction of the second cylindrical rack, the second cylindrical rack moving in the axial direction to rotate the rotation gears of the first or second contact unit and the third contact unit in opposite directions, and the central axes of the rotation gears of the first or second contact unit and the third contact unit are offset from each other in the axial direction of the second cylindrical rack.

4. The automatic head care device according to claim 3, further comprising an elastic member coupling the holding stage to the second holding stage, wherein the second holding stage is located closer to the head support than the holding stage by the elastic member.

5. The automatic head care device according to claim 1, wherein the rear-head care unit further includes:

a drive shaft transmitting an output from the oscillating actuator; and two split units each having the first and second contact units, the holding stage, and the cylindrical rack, central axes of the two cylindrical racks being parallel to each other, and the two cylindrical racks moving in the same direction in the axial direction of the cylindrical rack via a gear disposed at the drive shaft, and the rotation gears of the adjacent contact units are held by the respective holding stages of the different split units, and are offset from each other in the axial direction of the cylindrical rack.

6. The automatic head care device according to claim 1, wherein the rear-head care unit further includes:

a drive shaft transmitting an output from the oscillating actuator; and two split units each having the first and second contact units, the holding stage, and the cylindrical rack, central axes of the two cylindrical racks being parallel to each other, and the two cylindrical racks moving in opposite directions in the axial direction of the cylindrical rack via a gear disposed at the drive shaft, and the rotation gears of the adjacent contact units are held by the respective holding stages of the different split units, and are located at the substantially same level in the axial direction of the cylindrical rack.

7. The automatic head care device according to claim 1, wherein the rear-head care unit further includes:

a drive shaft transmitting an output from the oscillating actuator; and two split units each having the first and second contact units, the holding stage, and the cylindrical rack, central axes of the two cylindrical racks being parallel to each other, and the two cylindrical racks moving in the same direction in the axial direction of the cylindrical rack via a gear disposed at the drive shaft, and the rotation gears of the adjacent contact units are held by the respective holding stages of the different split units, and are located at the substantially same level in the axial direction of the cylindrical rack.

8. The automatic head care device according to claim 1, comprising:

a pair of support shafts disposed on right and left respective sides of the head support;

a pair of arm rotation shafts extending substantially perpendicular to the respective support shafts, the arm rotation shafts being rotatable around the respective support shafts;

a pair of arms swingable around the respective support shafts in a forward and rearward direction of the person's head supported by the head support, the arms being rotatable around the respective arm rotation shafts to be closer to or away from the head while applying pressure;

a plurality of contacts provided at each of the pair of arms;

a pressure sensor detecting a pressing force of the contacts; and a control unit controlling driving of the pair of arms to care the person's head, caring the person's head being at least one of washing of scalp of the person's head, washing hair of the person's head, and massaging of the person's head, supported by the head support.

9. The automatic head care device according to claim 1, further comprising:

a water supplying unit supplying water or hot water to the rear-head care unit;

a washing agent supplying unit supplying washing agent to the rear-head care unit; and a conditioner supplying unit supplying conditioner to the rear-head care unit, wherein the rear-head care unit supplies water, hot water, washing agent, or conditioner to the person's rear head and washes the person's rear head.

10. An automatic head care method of caring the person's head, caring the person's head being at least one of washing of scalp of the person's head, washing hair of the person's head, and massaging of the person's head, by use of the automatic head care device according to claim 1.

* * * * *